US012760963B2

(12) United States Patent
Wikus

(10) Patent No.: US 12,760,963 B2
(45) Date of Patent: Oct. 13, 2026

(54) DEVICE FOR PURIFYING AND LIQUEFYING HELIUM AND ASSOCIATED METHOD

(71) Applicant: Bruker Switzerland AG, Fällanden (CH)

(72) Inventor: Patrick Wikus, Nürensdorf (CH)

( * ) Notice: Subject to any disclaimer, the term of this patent is extended or adjusted under 35 U.S.C. 154(b) by 561 days.

(21) Appl. No.: 18/554,738

(22) PCT Filed: May 13, 2022

(86) PCT No.: PCT/EP2022/063072

§ 371 (c)(1),
(2) Date: Jul. 5, 2024

(87) PCT Pub. No.: WO2022/248255

PCT Pub. Date: Dec. 1, 2022

(65) Prior Publication Data

US 2026/0243504 A1 Aug. 20, 2026

(30) Foreign Application Priority Data

May 27, 2021 (DE) ..... 102021205423

(51) Int. Cl.
*F25J 1/00* (2006.01)
*F25J 1/02* (2006.01)

(52) U.S. Cl.
CPC ..... *F25J 1/0007* (2013.01); *F25J 1/0225* (2013.01); *F25J 1/0258* (2013.01);
(Continued)

(58) Field of Classification Search
CPC .. F25J 2290/60; F25J 2220/02; F25J 2205/60; F25J 1/0258; F25J 1/0225; F25J 1/0007
See application file for complete search history.

(56) References Cited

U.S. PATENT DOCUMENTS 4,659,351 A * 4/1987 Stuber ..... F25J 1/0037 62/48.2
5,542,966 A 8/1996 D'Amico
(Continued)

FOREIGN PATENT DOCUMENTS

CN 105983293 A 7/2019
CN 107677045 A 4/2020
(Continued)

OTHER PUBLICATIONS

Choudhury, Anup et al., "Experimental helium liquefier with a GM cryocooler", Review of Scientific Instruments, American Institute of Physics, vol. 88, No. 6, (2017).
(Continued)

*Primary Examiner* — Filip Zec
(74) *Attorney, Agent, or Firm* — DECODE Legal Inc.

(57) ABSTRACT

An apparatus (100) for purifying and liquefying helium, comprising a cold head (3) with a room-temperature, rear end portion (5), and at least one rearmost cooling stage (8), which is warmest during operation, and one foremost cooling stage (10), which is coldest during operation, wherein the room-temperature end portion (5) and the cooling stages (8, 10) are arranged in succession along a direction of extension (ER) of the cold head (3), an adsorber bed (4) that is thermally coupled to the cold head (3), and a vacuum-insulated storage vessel (1) for liquefied helium, is characterized in that the apparatus (100) provides a gas space (12) into which the cold head (3) protrudes with its cooling stages (8, 10) and which contains the adsorber bed (4), wherein the gas space (12) leads from the room-temperature end portion (5) of the cold head (3), on which a feed connection (6) for helium gas to be purified is formed,
(Continued)

along the cold head (3) and via the adsorber bed (4) to the coldest cooling stage (10) of the cold head (3), and in that a thermal coupling of the cold head (3) to the adsorber bed (4) is provided from at least two coupling-out locations (14) on the cold head (3) to at least two coupling-in locations (15) on the adsorber bed (4), wherein a coupling-out region (16) over which the coupling-out locations (14) on the cold head (3) are distributed has a length ($L_{AK}$) of at least 5 cm in the direction of extension (ER) of the cold head (3), and wherein a coupling-in region (17) over which the coupling-in locations (15) on the adsorber bed (4) are distributed has a length ($L_{EK}$) of at least 5 cm in the direction of extension (ER) of the cold head (3). The apparatus allows helium to be purified and liquefied easily and efficiently.

17 Claims, 9 Drawing Sheets

(52) U.S. Cl.
CPC ..... *F25J 2205/60* (2013.01); *F25J 2220/02* (2013.01); *F25J 2290/60* (2013.01)

(56) References Cited

U.S. PATENT DOCUMENTS

| | | | | |
|---|---|---|---|---|
| 7,059,138 | B2 * | 6/2006 | Bonaquist | F25B 9/145 62/48.1 |
| 9,671,159 | B2 * | 6/2017 | Diederichs | F25D 19/00 |
| 9,676,628 | B2 * | 6/2017 | Shah | B01D 53/229 |
| 10,753,682 | B2 * | 8/2020 | Demolliens | F25J 1/0259 |
| 10,859,293 | B2 * | 12/2020 | Wu | F25B 9/145 |
| 11,047,604 | B2 * | 6/2021 | Li | F25B 41/00 |
| 11,231,144 | B2 * | 1/2022 | Lose | F17C 13/026 |
| 11,630,172 | B2 * | 4/2023 | Laukien | G01R 33/3804 324/322 |
| 12,117,124 | B2 * | 10/2024 | Song | F17C 1/005 |
| 12,253,289 | B2 * | 3/2025 | Dunn | F25B 41/45 |
| 2016/0091245 | A1 | 3/2016 | Millan | |
| 2018/0120004 | A1 * | 5/2018 | Lee | F25B 41/00 |
| 2021/0199377 | A1 | 7/2021 | Choi | |
| 2025/0003677 | A1 * | 1/2025 | Brostow | F25J 3/0257 |

FOREIGN PATENT DOCUMENTS

| | | | |
|---|---|---|---|
| DE | 102013012656 | A1 | 2/2015 |
| EP | 2567159 | B1 | 12/2016 |
| JP | H11118349 | A | 4/1999 |
| JP | 2005083588 | A | 3/2005 |
| JP | 2008014878 | A | 1/2008 |
| JP | 4570546 | B2 | 10/2010 |
| KR | 102142312 | B1 | 8/2020 |
| WO | 2009086430 | A2 | 7/2009 |
| WO | 2016005463 | A1 | 1/2016 |

OTHER PUBLICATIONS

Wang, C., "Intermediate cooling from pulse tube and regenerator in a 4K pulse tube cyrocooler", Cyrogenics 48(3), 2008.
"Automatic Helium Purifier", https://www.cryomech.com/articles/automatic-helium-purifier [access on Jan. 24, 2023].
"Helium Gas Purifier", https://qd-europe.com/ch/en/product/helium-gas-purifier/ [access on Jan. 24, 2023].
"Cyrogenic Purification", https://quantum-technology.com/purify/cryogenic-purification.html [access on Jan. 24, 2023].
"Helium Purifier and Liquefier", https://www.724pridecryogenics.com/en/prodetail.asp?id=701 [access on Jan. 24, 2023].
Fauve, E.A. et al., "Ras Laffan helium recovery unit 2" AIP Conference Proceedings (2012).
Wang, C. "Extracting Cooling from the Pulse Tube and Regeneratio in a 4 K Pulse Tube Cryocooler", in Cryocoolers 15, edited by S.D. Miller and R.G. Ross Jr., International Cryocooler Conference, Inc., Boulder, CO, 2009.

* cited by examiner

DEVICE FOR PURIFYING AND LIQUEFYING HELIUM AND ASSOCIATED METHOD

The invention relates to an apparatus for purifying and liquefying helium, comprising

- a cold head with
  - a room-temperature, rear end portion,
  - and at least one rearmost cooling stage, which is warmest during operation,
  - and one foremost cooling stage, which is coldest during operation,
  - wherein the room-temperature end portion and the cooling stages are arranged in succession along a direction of extension of the cold head,
- an adsorber bed that is thermally coupled to the cold head,
- and a vacuum-insulated storage vessel for liquefied helium.

Such an apparatus is known from JP H11-118349 A (=reference [D1]).

Liquid helium is used in fields where coolants with particularly low temperatures are required. Under normal pressure conditions, helium is in liquid form at 4.2 K. For example, helium can be used as a coolant when using superconducting magnets in order to keep the superconductor below its transition temperature. In practice, such superconducting magnets are used, for example, in magnetic resonance spectroscopy (NMR), in the operation of particle accelerators, and in magnetic resonance imaging (MRI) in the field of medical diagnostics.

Helium continues to be a versatile raw material that is also used in gaseous form. Helium is used, for example, in the food industry, where it is used as a propellant or packaging gas, in welding technology, where it is used as an inert gas, in gas discharge tubes or as a lifting gas for balloons and airships, to name just a few fields. However, this multiplicity of application examples requires a sufficiently good supply of helium.

Helium is present in some sources of natural gas. This gas mixture is mined and the helium is separated. Although new helium-containing sources of natural gas have been developed again and again in the last two decades, the consumption of helium is large and constantly increasing. This is then reflected in rising prices. In addition, helium is a non-renewable resource, so it seems imperative to reduce the consumption of freshly mined helium by recovering helium that has already been mined.

Such recovery often occurs, for example, in NMR laboratories, where the helium evaporated from the superconducting magnet is recaptured and liquefied for further use. Many NMR laboratories have a daily consumption of liquid helium of less than 50 liters. In such cases, liquefaction of the helium often takes place using liquefiers based on cryocoolers (such as pulse tube coolers or GM coolers). Such liquefiers are particularly sensitive to the purity of the helium gas supplied to them.

There are several ways that impurities can get into the helium circuit of a helium recovery system. For example, every time a line of the helium recovery system is opened, some air enters the helium circuit. Helium recovery systems often have balloon accumulators, the skin of which is at least partially permeable to air and moisture, thereby adding these undesirable components into the helium circuit. Furthermore, pumps and compressors are often integrated into the helium recovery systems, in which oil mist and cracking products of the pump oil get into the helium circuit during operation.

Such impurities freeze out in the liquefier on the cold surfaces of a so-called cold head. As a result, a layer of frozen impurities gradually forms, which increasingly insulates the cold head. Over time, the cold head is thermally insulated in such a way that there are no longer any sufficiently cold surfaces available and the helium can no longer be liquefied, or can no longer be liquefied at the desired rate. Additionally, if the liquefier has pipes or orifices with a small cross section, there is a risk of them becoming clogged with the frozen impurities. In order to remove the impurities, the liquefier must be warmed up to room temperature, which is an expensive and time-consuming process.

In order to ensure sufficient purity of the helium gas, a so-called cryogenic purifier is usually installed upstream of the liquefier. For this purpose, the helium gas to be purified is usually cooled in this purifier to a temperature between 40 and 100 K and fed through an adsorber bed (e.g. a bed of activated carbon). In the adsorber bed, the impurities then freeze out on the large surface made available by the activated carbon. In order to achieve a good purification effect, the cryogenic purifier must be regenerated regularly. For this purpose, the adsorber bed is warmed up to room temperature so that the adsorbed impurities can be desorbed and then pumped off. The cooling of these cryogenic purifiers takes place either with liquid nitrogen, which has the disadvantage that it evaporates over time and has to be refilled regularly, or with a separate cryocooler for the purifier. Such separate cryogenic purifiers have become known, for example, from the following Internet publications:

- "AUTOMATIC HELIUM PURIFIER" from Cryomech Inc, Syracuse (New York, USA), cf. https://www.cryomech.com/articles/automatic-helium-purifier/of 14.04.2021 (=reference [D8]);
- "Helium gas purifier" from Quantum Design GmbH, Darmstadt (Hessen, DE), cf. https://qd-europe.com/ch/en/product/helium-gas-purifier/of 14.04.2021 (=reference [D9]);
- "Cryogenic Purification" from Quantum Technology Corp., Sqamish (British Columbia, CA), cf. https://quantum-technology.com/purify/cryogenic-purification.html of 14.04.2021 (=reference [D10]);
- "KDHPS-CC Helium Purifier" from CSIC Pride (Nanjing) Croygenic Technology Co., Ltd., Nanjing (Jiangsu, CN), cf. https://www.724pridecryogenics.com/en/prodetail.asp?id=701 of 15.04.2021 (=reference [D11]);

The separate purifier contributes significantly to the overall energy consumption of the helium recovery system and entails additional maintenance costs since the purifier is operated with its own cold head and its own compressor. The separate purifier also increases the technical complexity of the system, since a second compressor, an additional power connection, additional space for installation, and possibly an additional connection for water cooling are required, to name just a few examples.

Furthermore, the helium that has passed through the adsorber bed of the purifier is warmed up to room temperature before it is fed to the liquefier, in order to then be cooled down there again. This is thermodynamically inefficient.

JP 4 570 546 B2 (=reference [D2]) describes a liquefier which comprises two cold heads each with two or more cooling stages, which cools helium and then liquefies it. Prior purification of the helium gas is not discussed.

WO 2016/005463 A1 (=reference [D3]) describes an apparatus in which cold traps can be used to purify a gas stream. Counterflow heaters are used to be more thermodynamically efficient. Cooling in the apparatus takes place only at the two temperature levels that are available at the two stages of the cold head.

EP 2 567 159 B1 (=reference [D4]) describes a liquefier that liquefies helium with a cryocooler. In order to increase the efficiency of the liquefaction, the pressure in the system is increased, which means that the gaseous helium can be liquefied even at higher temperatures. In order to remove the impurities deposited on the cold head, the cold head is periodically heated to loosen the impurities. However, the impurities fall into the storage volume with the liquid helium, which means that the impurities are not removed from the helium system. The heat load on the helium bath also increases due to the heating of the cold head.

KR 10 2142312 B1 (=reference [D5]) describes a liquefier for helium which is connected to a purifier.

CN 107677045 A (=reference [D6]) describes an apparatus for purifying helium. Purification takes place via a heat exchanger and a phase separator.

It has become known from Wang, "Intermediate cooling from pulse tube and regenerator in a 4K pulse tube cryocooler," Cryogenics 48 (3): 154-159 (=reference [D7]) to thermally couple heat exchangers to a pulse tube of a cold head and a regenerator, since cooling power can be tapped there without significantly impairing the cooling power of the coldest cooling stage.

JP H11-118349 A, mentioned at the outset, describes an apparatus with which helium gas can be purified and liquefied. In this case, a purifier is coupled to the first stage of a first cold head via a heat contact element. As a result, the purifier is cooled to the temperature of the first stage of the first cold head of approx. 60 K, and the impurities from the helium gas that is passed through can be frozen out. The purified helium gas is then passed on to the cooling stages of the first and a second cold head of the cryocooler, further cooled, and finally liquefied at the second cooling stage of the second cold head.

The disadvantage of this procedure is that the impurities in the purifier are frozen out at much lower temperatures than necessary for most impurities. This is thermodynamically inefficient. In addition, the structure of the apparatus is complex.

OBJECT OF THE INVENTION

It is the object of the present invention to provide an apparatus by means of which helium can be easily and efficiently purified and liquefied.

DESCRIPTION OF THE INVENTION

This object is achieved according to the invention by an apparatus of the type mentioned at the outset, which is characterized in that

- the apparatus provides a gas space into which the cold head protrudes with its cooling stages and which contains the adsorber bed,
- wherein the gas space leads from the room-temperature end portion of the cold head, on which a feed connection for helium gas to be purified is formed, along the cold head and via the adsorber bed to the coldest cooling stage of the cold head, and in that a thermal coupling of the cold head to the adsorber bed is provided from at least two coupling-out locations on the cold head to at least two coupling-in locations on the adsorber bed,
- wherein a coupling-out region over which the coupling-out locations on the cold head are distributed has a length of at least 5 cm in the direction of extension of the cold head,
- and wherein a coupling-in region over which the coupling-in locations on the adsorber bed are distributed has a length of at least 5 cm in the direction of extension of the cold head.

The present invention proposes that the liquefier and the adsorber bed be integrated into one unit and operated with a single cold head. The adsorber bed and the cold head are thermally coupled via a plurality of coupling-out and coupling-in locations that are distributed along the direction of extension of the cold head. In this case, a plurality of discrete (separate from one another) coupling-out and coupling-in locations can be provided, or a multiplicity of coupling-out and coupling-in locations follow one another directly, so that a continuous thermal coupling is provided in practice. As a result, different temperatures can be provided in the adsorber bed for the adsorption of impurities. For this purpose, discrete (separate) regions in the adsorber bed with different temperatures or a temperature gradient can be provided within the adsorber bed.

Helium gas to be liquefied and possibly containing impurities is fed in at the feed connection ("helium gas to be purified") in order to free it from impurities using the adsorber bed. When the helium gas to be purified is fed through the established gas space, impurities such as water, hydrocarbons, oxygen, or nitrogen can be adsorbed/frozen out in the adsorber bed at comparatively high temperatures, and often at the highest possible temperature. In particular, various types of impurities can be adsorbed/frozen out in different regions in the adsorber bed at different temperatures. Thermodynamically, this is more efficient than adsorbing/freezing out all impurities at a single, uniform temperature which must be chosen to be low enough to include those impurities that are adsorbed/frozen out at the lowest temperatures.

Adsorption of impurities takes place over a certain temperature range. This temperature range is above the freezing point of the relevant impurity. The lower the temperature, the greater the proportion of impurity adsorbed compared to the proportion of impurity in the helium gas, with the impurity being practically completely adsorbed at the freezing point. For the sake of simplification, adsorption above the freezing point is also referred to as "freezing out" the impurity. In addition to the temperature, the adsorbed proportion of the impurity depends, among other things, on the size of the surface of the adsorber bed, the material of the adsorber bed, and the partial pressure of the relevant impurity. The temperature at which 50% of the relevant impurity is bound by the adsorber bed in equilibrium and 50% remains in the gas phase is referred to here as the adsorption temperature. This adsorption temperature is used in the following to indicate the temperature or a temperature range surrounding this temperature at which the adsorption of the relevant impurity essentially takes place.

Within the scope of the invention, the relevant adsorption heat of the various impurities can be absorbed at a comparatively high and often at the highest possible temperature, i.e. for a large part of the impurities at a higher temperature than the lowest temperature provided in the adsorber bed. The provision of cooling power at this higher temperature is significantly easier (more efficient) than the provision of cooling power at the lowest temperature provided in the adsorber bed.

The coldest cold stage of the cold head has (in operation) a temperature $T_k$ which is sufficient to liquefy gaseous helium flowing through the gas space; in the case of a helium gas pressure of approx. 1 bar, the coldest cooling stage typically has a temperature $T_k$ of approx. 4.2 K. When flowing through the gas space, the gaseous helium is gradually cooled along the direction of extension of the cold head, from the room-temperature end to the coldest cooling stage. As a result, the thermodynamic efficiency during the liquefaction of the helium can be improved.

The adsorber bed can be designed as a one-piece, continuous adsorber in the gas space, or can comprise a plurality of separate adsorbers in the gas space. The adsorber bed is understood to mean the entirety of all adsorbers arranged in the gas space.

Purifying and liquefying of the helium gas take place in a single gas space provided around a single cold head. A further cold head, which would only be responsible for cooling the adsorber bed, is not required within the scope of the invention; in addition, a transport of the helium gas between a separate purifier and a liquefier, which is usually accompanied by heating of the helium gas and would be thermodynamically inefficient, can be avoided. The space requirement of the apparatus according to the invention can be kept small and the purifying and liquefying of helium gas can be made particularly efficient thermodynamically.

The cold head provides the active cooling power. The adsorber bed is thermally coupled to the cold head as a passive component. A thermal coupling between a coupling-out location on the cold head and a coupling-in location on the adsorber bed is typically provided by direct solid-state contact or by radiation/convection via a (small) gap, wherein the (small) gap preferably has a maximum width of ⅓, particularly preferably a maximum width of ⅕, very particularly preferably a maximum width of 1/10 of the length of the coupling-out region. The width of the gap is then typically ≤5 mm, often ≤3 mm. The thermal coupling can be improved in the case of radiation/convection, the smaller the width of the (small) gap. The terms coupling-out location on the cold head and coupling-in location on the adsorber bed do not define a specific direction of heat flow.

The coupling-out region on the cold head is delimited by the coupling-out locations that are farthest apart in the direction of extension of the cold head. Likewise, the coupling-in region on the adsorber bed is delimited by the coupling-in locations that are farthest apart in the direction of extension of the cold head. The length of the coupling-out region in the direction of extension of the cold head of at least 5 cm, preferably at least 8 cm, particularly preferably at least 10 cm, ensures that different cold regions of the cold head are used to cool the adsorber bed during operation on the cold head. The length of the coupling-out region in the direction of extension of the cold head of at least 5 cm, preferably at least 8 cm, particularly preferably at least 10 cm, ensures that correspondingly different cold regions are provided in the adsorber bed during operation for freezing out the various impurities in the helium gas to be purified.

Advantageously, the adsorber bed can be shaped in such a way that it at least locally occupies a proportion ANT of the cross section of the gas space (perpendicular to the direction of extension of the cold head) available for a flow of helium gas, where ANT≥90%, preferably ANT≥95%, particularly preferably ANT=100%. In a particularly advantageous manner, the adsorber bed can be shaped in such a way that, over a purification length in the direction of extension of the cold head of at least 5 cm, preferably at least 8 cm, particularly preferably at least 10 cm, it contains the proportion ANT of the cross section of the gas space available for a flow of helium gas, measured perpendicularly to the direction of extension of the cold head.

A high value of ANT minimizes the proportion of helium gas to be purified that can flow past the adsorber material, thereby maximizing the purifying effect of the apparatus or the adsorber bed. The purification length in which the high proportion of ANT is present preferably corresponds to at least 75%, preferably at least 90%, very particularly preferably 100% of the length of the coupling-in region.

When determining ANT, regions of porosity within the adsorber are attributed to the proportion of the cross section of the gas space occupied by the adsorber bed. The local cross section of the gas space typically corresponds to the local internal cross section of a cold head container or a neck tube of the storage vessel, minus the local cross section of the cold head.

The adsorber bed is preferably arranged in the gas space in such a way that the entire gas stream of helium to be purified must flow through the adsorber bed, in particular over a minimum length of 5 cm, preferably 8 cm, particularly preferably 10 cm, along the direction of extension of the cold head and/or by penetrating two adsorber bed regions with a temperature difference of at least 50 K, preferably 100 K. In order to guide the helium gas stream completely through the adsorber bed, the cross section of the gas space is completely occupied by the adsorber bed (ANT=100%). Correspondingly, practically all impurities can be filtered out (frozen out) in the adsorber bed from the helium gas to be purified that flows into the apparatus from the outside, and the coldest cold stage is particularly well protected from impurities.

Preferred Variants of the Invention

In a preferred variant of the apparatus according to the invention, it is provided that a coupling-out temperature difference at the cold head between a rearmost coupling-out location nearest to the room-temperature end of the cold head and a foremost coupling-out location nearest to the coldest cooling stage is at least 50 K, preferably at least 100 K, and that a coupling-in temperature difference at the adsorber bed between a rearmost coupling-in location nearest to the room-temperature end of the cold head and a foremost coupling-in location nearest to the coldest cooling stage is at least 50 K, preferably at least 100 K. In practice, these temperature differences are easy to provide and result in a significant increase in thermodynamic efficiency compared to a uniform adsorber temperature. The various impurities can be frozen out at a comparatively high, and often at the highest possible, temperature.

Also preferred is an embodiment that provides for a continuous thermal coupling to be provided between at least one section of the cold head and at least one section of the adsorber bed along the direction of extension of the cold head, wherein the relevant section of the cold head extends in the direction of extension of the cold head over at least a length of 5 cm, and the relevant section of the adsorber bed extends in the direction of extension of the cold head over at least a length of 5 cm. In principle, the continuous thermal coupling takes place at least approximately orthogonally to the direction of extension. Due to the continuously provided thermal coupling between the section of the cold head and the section of the adsorber bed, a temperature gradient can be provided in the section of the adsorber bed, so that all temperatures occur in the adsorber bed (within the temperature range spanned by the temperature gradient); an impurity of which the adsorption temperature is within this spanned temperature range can freeze out at the adsorption temperature. On the other hand, the cooling power of the cold head, which also forms a temperature gradient, can be made available at the adsorption temperature of the impurity. This is thermodynamically highly efficient. The lengths of the respective sections of the cold head and of the adsorber bed in the direction of extension of the cold head have proven particularly useful in practice; the lengths of the sections are preferably at least 8 cm, particularly preferably at least 10 cm, in the direction of extension of the cold head. A sufficiently large temperature gradient can usually be provided over these lengths. A section of the cold head (and an associated section of the adsorber bed) can be provided between the room-temperature end portion and the warmest cooling stage. A corresponding further section of the cold head (and an associated section of the adsorber bed) can be provided between two cooling stages (e.g. the warmest cooling stage and the coldest cooling stage in a total of two-stage cold head). A corresponding section of the cold head typically extends at least over half the length of a regenerator tube which runs between the room-temperature end portion and the warmest cooling stage or between two cooling stages of the cold head. A section of the cold head and a section of the adsorber bed, between which a continuous thermal coupling is provided, each comprise a multiplicity of coupling-out locations or coupling-in locations.

In a preferred development of this embodiment, it is provided that a rear section of the cold head is provided between the room-temperature end portion and the warmest cooling stage, and a rear section of the adsorber bed that is continuously thermally coupled to this is provided, wherein the warmest cooling stage has a temperature $T_w$, that, along the rear section of the cold head in the direction of extension of the cold head, the cold head has a continuous temperature gradient which spans a temperature difference $TD_{HKK}$, where $TD_{HKK} \geq (293K - T_w)/2$, and that, along the rear section of the adsorber bed in the direction of extension of the cold head, the adsorber bed has a continuous temperature gradient which spans a temperature difference $TD_{HAD}$, where $TD_{HAD} \geq (293K - T_w)/2$. With the adsorber bed provided in this way, impurities in the helium gas to be purified of which the adsorption temperatures are above the temperature $T_w$ of the warmest cooling stage can be frozen out at or close to their adsorption temperature, which is thermodynamically efficient. $T_w$ is usually $T_w \geq 40K$ or $T_w \geq 50K$, and/or $T_w \leq 150K$ or $T_w \leq 100K$ or $T_w \leq 80K$.

Also preferred is a development of this embodiment, which is characterized in that at least one further section of the cold head is provided between a warmer cooling stage and a colder cooling stage of the cold head, and at least one further section of the adsorber bed that is continuously thermally coupled to this is provided, wherein, in each case, the warmer cooling stage has an upper temperature $T_{ob}$ and the colder cooling stage has a lower temperature $T_{unt}$, in that, in each case along the further section of the cold head in the direction of extension of the cold head, the cold head has a continuous temperature gradient which spans a temperature difference $TD_{WKK}$ where $$TD_{WKK} \geq (T_{ob} - T_{unt})/2,$$

and in that, in each case along the further section of the adsorber bed in the direction of extension of the cold head, the adsorber bed has a continuous temperature gradient which spans a temperature difference $TD_{WAD}$, where $$TD_{WAD} \geq (T_{ob} - T_{unt})/2.$$

With a further adsorber bed provided in this way, impurities in the helium gas to be purified of which the adsorption temperatures are below the temperature $T_{ob}$ and above the temperature $T_{unt}$ can be frozen out close to or at their adsorption temperatures, which is thermodynamically efficient. If the cold head comprises exactly two cooling stages, $T_{ob}$ is also $T_w$, and the temperature $T_{unt}$ is also $T_k$ and is selected in such a way that helium can be liquefied.

Also preferred is an embodiment in which the vacuum-insulated storage vessel is designed with a neck tube, wherein the cold head protrudes into the neck tube and the adsorber bed is arranged in the neck tube, and an inner wall of the neck tube delimits the gas space laterally, and the gas space is open downward into the vacuum-insulated storage vessel. This structure is particularly simple and inexpensive; in addition, relatively large cross sections can be provided for purifying the helium gas.

Also preferred is an embodiment in which the apparatus comprises a cold head container, wherein the cold head protrudes into the cold head container, and the adsorber bed is arranged in the cold head container, and wherein the cold head container delimits the gas space to the outside. The cold head container makes it easier to guide the helium gas stream in the gas space. The adsorber bed can be placed and fixed around the cold head in a particularly simple manner, in particular more easily than in the case of a direct arrangement of the cold head and the adsorber bed in the neck tube of the storage vessel. In addition, a certain thermal insulation from the surroundings of the cold head container can be achieved with the cold head container, in particular during a bake-out of the adsorber bed.

A preferred development is characterized in that the cold head container is designed to be vacuum-insulated. As a result, the cold head container can be better thermally insulated from its surroundings. The heat input from the cold head container into the vacuum-insulated storage vessel can be minimized, in particular during a bake-out of the adsorber bed.

A further development of this development in which the cold head container is arranged outside of the vacuum-insulated storage vessel, in particular wherein an underside outflow of the cold head container is connected to the vacuum-insulated storage vessel via a line, is advantageous. As a result, the heat input from the cold head container into the vacuum-insulated storage vessel can be minimized during a bake-out of the adsorber bed. In addition, it is easier to separate the storage vessel and the assembly of the cold head container, for example to keep the assembly and in particular the cold head away from strong magnetic fields if the storage vessel has to be brought into the immediate vicinity of a superconducting magnet for a helium transfer. The line is preferably provided with thermal insulation.

An advantageous development provides that the cold head container protrudes into the vacuum-insulated storage vessel, in particular into a neck tube of the vacuum-insulated storage vessel. The helium liquefied in the cold head container can then be released directly into the vacuum-insulated storage vessel, which minimizes heat input into the liquefied helium and heat losses in the transfer path between the cold head container and the storage vessel. Furthermore, the space requirement of the apparatus can be reduced.

In a particularly preferred further development of this development, the cold head container has an outflow capillary for liquid helium, which outflow capillary leads through an underside vessel wall of the cold head container to the vacuum-insulated storage vessel and opens into the gas space at the inner base of the cold head container, in particular wherein the outflow capillary for liquid helium is designed with a closable valve. With the outflow capillary, a transfer of liquefied helium from the cold head container to the storage vessel is possible in a simple manner, with only minimal heat input from the cold head container into the vacuum-insulated storage vessel being able to take place via the outflow capillary during the bake-out of the adsorber bed. The closable valve can be closed during a bake-out of the adsorber bed in order to further minimize the heat input into the storage vessel. The closable valve is typically arranged at the gas-space-side end of the outflow capillary.

A development is advantageous which provides that the cold head container has a recirculation capillary for evaporated helium from the vacuum-insulated storage vessel, which recirculation capillary leads through an underside vessel wall of the cold head container and opens into the gas space above an inner base of the cold head container, in particular at the coldest cooling stage, in particular, wherein the recirculation capillary for evaporated helium is designed with a closable valve. With the recirculation capillary, evaporated helium can be recirculated from the vacuum-insulated storage vessel to the cold head for liquefaction. If the recirculation capillary opens directly at the coldest cold stage, the evaporated helium, which has a temperature of approximately 4.2 K, does not heat up excessively before it is liquefied again at the cold stage. In addition, mixing with not yet (completely) purified helium in the gas space is minimized. Since the recirculation capillary opens above the inner base, a backflow of helium liquefied in the cold head container through the recirculation capillary (and thus a blockage of the recirculation capillary for gaseous helium) is prevented. During the bake-out of the adsorber bed, at most minimal heat input from the cold head container into the vacuum-insulated storage vessel takes place by means of the recirculation capillary. The closable valve of the recirculation capillary, which can be arranged at the gas-space-side end of the recirculation capillary, is closed during a bake-out of the adsorber bed in order to further minimize the heat input into the storage vessel.

In the above developments, it is advantageously provided that the outflow capillary for liquid helium and/or the recirculation capillary for evaporated helium have a length L within the underside vessel wall of the cold head container which is greater than a wall thickness of the underside vessel wall, in particular wherein the outflow capillary and/or the recirculation capillary are spiral-shaped. As a result, the heat input via the capillaries from the cold head container to the vacuum-insulated storage vessel can be reduced even further during the bake-out of the adsorber bed. The larger capillary length L increases the thermal conduction resistance.

In a further preferred development, at least one passage for evaporated helium from the vacuum-insulated storage vessel is formed at an upper end of the cold head container, which end is arranged close to the room-temperature end portion of the cold head, in particular wherein an annular gap space is provided within the vacuum-insulated storage vessel between an inner wall of the vacuum-insulated storage vessel and an outer wall of the cold head container, and the at least one passage leads from an upper region of the annular gap space into an upper region of the cold head container. In this way, evaporated helium which rises in the storage vessel, in particular in the neck tube, can be immediately supplied to the cold head container and liquefied. By means of the annular gap, the neck tube and the wall of the cold head container can be cooled over its entire circumference by the rising gaseous helium. In the cold head container, it should be ensured that helium gas to be purified that is externally supplied via the feed connection flows primarily along the cold head through the adsorber bed, and not unpurified from the cold head container through the passage directly into the storage vessel or annular gap; for this purpose, the passage and the feed connection in the cold head container can be separated from one another, in particular by a suitable thickness of adsorber bed material.

It is preferred in the above development that at least one flow line is formed in the cold head container and leads from the at least one passage at the upper end of the cold head container along the cold head to the coldest cooling stage and opens into a lower region of the gas space. As a result, convection of clean or already purified gaseous helium gas from the storage vessel past the outside of the cold head container and back through the cold head container can be maintained in a simple manner without mixing with as-yet unpurified helium gas in the gas space, with the already clean helium gas from the storage vessel being liquefied again at the coldest cold stage.

Embodiments of an Attachment Part

A preferred embodiment provides that the vacuum-insulated storage vessel has a vacuum-insulated main part and an attachment part, and that there is a separating slide between the main part and the attachment part, wherein the main part is sealed in a gas-tight manner on the separating slide when the separating slide is in a closed state, and in an open state of the separating slide the interior spaces of the main part and attachment part are open toward one another. The cold head and the adsorber bed can be arranged at least temporarily in the attachment part. The main part (with the liquefied helium) and the attachment part (typically with the cold head and the adsorber bed) can be thermally separated from one another as far as possible by separating the main part from the attachment part in a gas-tight manner using the separating slide. If, for example, the cold head and the adsorber bed are regenerated (baked out), the heat input from the direction of the attachment part into the main part or the liquefied helium can be reduced or completely prevented. The attachment part can also be designed to be vacuum-insulated or be designed without vacuum insulation. Typically, the separating slide is formed in the region of a neck tube of the vacuum-insulated storage vessel.

In a preferred development of this embodiment, it is provided that the attachment part is designed with a flexible wall, in particular a bellows, that an assembly at least comprising the cold head and the adsorber bed is designed to be movable relative to the main part of the vacuum-insulated storage vessel, and that, in an extended state, the assembly extends only in the attachment part, but not in the main part, so that the separating slide can be closed, and in a retracted state the assembly protrudes into the main part. In this configuration, the assembly comprising the cold head and the adsorber bed can be simply and easily sunk into or withdrawn from the main part of the vacuum-insulated storage vessel while maintaining the seal of the storage vessel at all times. In the retracted state, the cold head is particularly close to the liquefied helium in the storage vessel, and good thermodynamic efficiency can be achieved. Additionally, the space requirement when the apparatus is in the retracted state (in liquefaction mode) can be reduced. Likewise, the assembly in the attachment part can be largely thermally separated from the main part in the extended state (for the regeneration mode) by closing the separating slide. If a cold head container is provided, this also belongs to the mobile assembly. The bellows can in particular be designed as a metal bellows.

A further preferred development provides that, when the separating slide is in the closed state, the main part and the attachment part can be separated from one another, with the cold head and the adsorber bed extending only in the attachment part but not in the main part. In the separated state, the main part can be brought to a location remote from the attachment part, while the cold head and the at least one adsorber bed remain at the location of the attachment part. For example, if the main part is brought into the vicinity of a strong NMR magnet in order to refill liquid helium there for cooling, the attachment part with the cold head and the adsorber bed can be stored separately and remotely; then the cold head does not need to be designed to be compatible with (possibly large) stray magnetic fields, which considerably simplifies the construction of the cold head and makes the cold head considerably cheaper. Since the cold head in the attachment part is connected to a multiplicity of gas lines (e.g. to a compressor) and electrical lines, operation is greatly simplified if the attachment part can always remain in place and does not have to be moved far, which would require the lines to be disconnected.

Further Embodiments

Also preferred is an embodiment which is characterized in that a discharge connection for impurities is formed on the room-temperature end portion of the cold head, in particular wherein, furthermore, a flushing line for a flushing gas leads from the room-temperature end portion of the cold head to the coldest cooling stage and opens into a lower region of the gas space, and in particular wherein the discharge connection is connected to a discharge line in which a suction pump is arranged. Impurities can thus be easily removed. For this purpose, the temperature of the cold head and adsorber bed can be increased to room temperature, for example. With the flushing gas (e.g. helium, argon, or nitrogen) which is introduced with the flushing line close to the coldest cold stage, the gas space can be flushed counter to the flow direction of normal operation in the direction of the room-temperature end portion, where the discharge connection is formed. As a result, impurities can be removed particularly quickly and completely. A suction pump (e.g. an oil vane pump or a diaphragm pump) can be used to efficiently suck out impurities; the partial pressure of impurities is lowered by negative pressure in the gas space, and these can desorb even more easily.

Also preferred is an embodiment in which a filling level sensor for liquid helium is formed in the vacuum-insulated storage vessel. In this way, the filling level and the point in time at which the storage vessel should be emptied or should no longer be filled can be determined. The liquefied helium can be removed, for example, via a connection (port) on the vacuum-insulated storage vessel.

Also preferred is an embodiment that provides for a storage vessel heating element to be provided in the vacuum-insulated storage vessel, with which helium can be heated in the vacuum-insulated storage vessel. This allows the pressure in the storage vessel to be increased if necessary.

Also preferred is an embodiment which is characterized in that at least one adsorber heating element is provided, with which the adsorber bed can be heated. In this way, the adsorber bed can be heated more quickly in the regeneration phase. In addition, impurities that have higher boiling points can be more effectively removed from the adsorber bed. Typically, the adsorber bed is heated to room temperature, in some cases to a higher temperature.

Also preferred is an embodiment in which a temperature sensor is formed in each case in the vacuum-insulated storage vessel and/or on the cold head, in particular on the coldest cooling stage, and/or on the adsorber bed. As a result, the apparatus can be monitored and, if necessary, controlled. In particular, malfunctions or irregularities can be detected, or the point in time of regeneration of the cold head and adsorber bed can be determined.

A further preferred embodiment is characterized in that at least one optical monitoring device is present with which the loading of at least one of the cooling stages of the cold head with impurities can be monitored, in particular wherein the at least one optical monitoring device has a glass fiber line. The point in time for the regeneration of the cold head can be determined by this optical monitoring device. Regeneration should take place in particular when the observed cooling stage of the cold head is visibly completely covered by a frozen layer of impurities. An optical monitoring device is preferably provided for each cooling stage. A further glass fiber line can be provided for lighting purposes.

An embodiment is also preferred in which a monitoring device is present which, in the case of the presence of

- a pressure difference between the feed connection and the vacuum-insulated storage vessel greater than a pressure difference limit value, with a defined helium inflow being provided at the feed connection, or
- a flow rate of helium supplied at the feed connection that is less than a flow rate limit value, with defined pressures being adjusted at the feed connection and in the vacuum-insulated storage vessel, generates a signal to indicate the need for regeneration of the adsorber bed and/or automatically initiates regeneration of the adsorber bed. In this way, the point in time of the regeneration of the adsorber bed can be easily determined and the user's attention drawn to this. Automatic regeneration of the adsorber bed can also be provided in this simple way. The pressure difference limit value can be defined as a limit curve depending on the helium flow provided. The flow rate limit value can be defined as a boundary surface depending on the adjusted pressures or as a limit curve depending on the adjusted pressure difference.

A further preferred embodiment provides that the adsorber bed comprises an activated carbon bed and/or contains a material which has an inner surface area of at least 300 $m^2/g$, preferably at least 900 $m^2/g$. The impurities can be frozen out on this large, inner surface. A larger inner surface can also allow for greater loading with impurities, which means that the adsorber bed needs to be regenerated less frequently.

An embodiment is also preferred which is characterized in that the vacuum-insulated storage vessel is provided with a pressure sensor, and in that there is also a control unit which is designed to regulate a heating power at a storage vessel heating element and/or a cooling power at the cold head based on the pressure in the vacuum-insulated storage vessel, in particular so that the pressure in the vacuum-insulated storage vessel does not drop below a lower limit pressure $P_{untgr}$ and does not increase above an upper limit pressure $P_{obgr}$. This can prevent negative pressure from developing in the vacuum-insulated storage vessel (e.g. if the cooling power of the cold head exceeds the heat load on the helium bath) and air being introduced (sucked in) from the surroundings. It is also possible to prevent overpressure from developing in the vacuum-insulated storage vessel, which would result in helium escaping via a safety valve and being lost.

Helium Recovery System According to the Invention

A helium recovery system also falls within the scope of the present invention, comprising an apparatus according to the invention for purifying and liquefying helium as described above and at least one helium-cooled application device and a balloon accumulator for gaseous helium, wherein a first supply line for gaseous helium and a second supply line for gaseous helium are connected to the feed connection via a branch, wherein the first supply line leads from the balloon accumulator to the branch, in particular wherein the first supply line further contains a compressor and a pressure accumulator for gaseous helium, and wherein the second supply line leads from the at least one helium-cooled application device to the branch while bypassing the balloon accumulator. A helium recovery system provided in this manner can be used flexibly in different situations. The balloon accumulator for gaseous helium can be used when large amounts of gaseous helium are produced in a short time, for example when refilling liquid helium into a helium-cooled application device. This can prevent overloading of the apparatus (i.e. the cold head and the adsorber bed during purification and liquefaction) and the resulting helium gas can later be supplied slowly from the balloon accumulator to the apparatus, possibly also via a compressor and a high-pressure accumulator. During normal operation of helium-cooled application devices, it is advantageous to feed evaporating helium directly (while bypassing the balloon accumulator) to the cold head and adsorber bed, since the amounts of evaporated helium are usually small and the evaporated helium is usually very dry and pure. The detour via the balloon accumulator, where a not inconsiderable amount of moisture or air is usually introduced, can thus be avoided, and contamination of the helium gas on the path from the application device to the apparatus can be significantly reduced or avoided entirely.

Method According to the Invention for Purifying and Liquefying Helium

Also within the scope of the present invention is a method for purifying and liquefying helium, wherein a helium gas to be purified is passed through an adsorber bed and thus purified, wherein the adsorber bed is cooled with a cold head, wherein the cold head comprises at least two cooling stages, namely at least one warmest cooling stage, which is operated at a temperature $T_w$, and a coldest cooling stage, which is operated at a temperature $T_k$, where $T_w > T_k$, and wherein helium gas purified by the adsorber bed is liquefied, and liquefied helium is collected in a vacuum-insulated storage vessel, characterized in that the helium gas to be purified is fed into a gas space into which the cold head protrudes with its cooling stages and which contains the adsorber bed, wherein the helium gas to be purified is guided through the gas space from a room-temperature end portion of the cold head, on which a feed connection for the helium gas to be purified is formed, along the cold head and via the adsorber bed to the coldest cooling stage of the cold head, the temperature $T_k$ of which is selected such that helium gas purified by the adsorber bed is liquefied at the coldest cooling stage, and that a thermal coupling of the cold head to the adsorber bed is provided from at least two coupling-out locations on the cold head to at least two coupling-in locations on the adsorber bed, such that a coupling-out temperature difference at the cold head between a rearmost coupling-out location nearest to the room-temperature end of the cold head and a foremost coupling-out location nearest to the coldest cooling stage is at least 50 K, preferably at least 100 K, and a coupling-in temperature difference at the adsorber bed between a rearmost coupling-in location nearest to the room-temperature end of the cold head and a foremost coupling-in location nearest to the coldest cooling stage is at least 50 K, preferably at least 100 K.

When the helium gas to be purified is fed into the gas space, impurities such as water, hydrocarbons, oxygen, or nitrogen in the adsorber bed can already be frozen out at or close to their corresponding adsorption temperature. The purified helium gas is liquefied at the coldest cold stage and collected in the storage vessel. The adsorber bed and the cold head are thermally coupled via at least two coupling-out and coupling-in locations that are distributed along the direction of extension of the cold head. A plurality of discrete (separate from one another) coupling-out and coupling-in locations can be provided, or a multiplicity of coupling-out and coupling-in locations follow one another directly, so that a continuous thermal coupling is provided in practice. In this way, different temperatures for the adsorption of impurities can be provided in the adsorber bed, as a result of which an adaptation or approximation to the different adsorption temperatures of the different impurities takes place according to the invention.

The coupling-out temperature differences and coupling-in temperature differences according to the invention are easy to provide in practice and result in a significant increase in thermodynamic efficiency compared to a uniform adsorber temperature corresponding to the adsorption temperature of the impurity with the lowest adsorption temperature which is still to be frozen out.

The helium gas to be purified ("gas stream") is preferably fed through the gas space in such a way that it must flow completely through the adsorber bed, in particular over a minimum length of 5 cm, preferably at least 8 cm, particularly preferably at least 10 cm along the direction of extension of the cold head, and/or by penetrating two adsorber bed regions with a temperature difference of at least 50 K, preferably 100 K. The method preferably takes place on an apparatus according to the invention as described above.

In a preferred variant of the method according to the invention, it is provided that the room-temperature end portion and the cooling stages are arranged in succession along a direction of extension of the cold head, that a continuous thermal coupling is provided between at least one section of the cold head and at least one section of the adsorber bed along the direction of extension of the cold head, such that, along the section of the cold head in the direction of extension of the cold head, the cold head has a continuous temperature gradient which spans a temperature difference $TD_{TKK}$, where $TD_{TKK} \geq 25K$, preferably $TD_{TKK} \geq 50K$, and, along the section of the adsorber bed in the direction of extension of the cold head, the adsorber bed has a continuous temperature gradient which spans a temperature difference $TD_{TAD}$, where $TD_{TAD} \geq 25K$, preferably $TD_{TAD} \geq 50K$. Due to the continuously provided thermal coupling between the at least one section of the cold head and the at least one section of the adsorber bed, a temperature gradient can be provided in the at least one section of the adsorber bed, so that all temperatures occur in the adsorber bed (within the temperature range spanned by the temperature gradient, cf. the associated temperature difference $TD_{TAD}$). The temperature differences $TD_{TKK}$ and $TD_{TAD}$ are easy to provide in practice and result in a significant increase in thermodynamic efficiency compared to a uniform adsorber temperature corresponding to the adsorption temperature of the impurity with the lowest adsorption temperature which is to be frozen out. The various impurities can in many cases be frozen out at or particularly close to their respective adsorption temperatures.

A development of this variant is advantageous, which is characterized in that a rear section of the cold head is provided between the room-temperature end portion and the warmest cooling stage, and a rear section of the adsorber bed that is continuously thermally coupled to this is provided, the continuous temperature gradient at the rear section of the cold head spans a temperature difference $TD_{HKK}$, where $$TD_{HKK} \geq (293\,K - T_w)/2,$$

and the continuous temperature gradient at the rear section of the adsorber bed spans a temperature difference $TD_{HAD}$, where $TD_{HAD} \geq (293K - T_w)/2$. With the adsorber bed provided in this way, impurities in the helium gas flowing through of which the adsorption temperatures are above the temperature $T_w$ of the warmest cooling stage can be frozen out at or close to their adsorption temperature, which is thermodynamically efficient. $T_w$ is usually $T_w > 40K$ or $T_w > 50K$, and/or $T_w \leq 150K$ or $T_w \leq 100K$ or $T_w \leq 80K$.

A continuation of this development is also preferred, in which at least one further section of the cold head is provided between a warmer cooling stage and a colder cooling stage of the cold head, and at least one further section of the adsorber bed that is continuously thermally coupled to this is provided, wherein, in each case, the warmer cooling stage has an upper temperature $T_{ob}$ and the colder cooling stage has a lower temperature $T_{unt}$, in each case the continuous temperature gradient at the further section of the cold head spans a temperature difference $TD_{WKK}$, where $$TD_{WKK} \geq (T_{ob} - T_{unt})/2,$$

and in each case the continuous temperature gradient at the further section of the adsorber bed spans a temperature difference $TD_{WAD}$, where $$TD_{WAD} \geq (T_{ob} - T_{unt})/2.$$

With a further adsorber bed provided in this way, impurities in the helium gas flowing through of which the adsorption temperatures are below the temperature $T_{ob}$ and above the temperature $T_{unt}$ can be frozen out close to or at their adsorption temperature, which is thermodynamically efficient. If the cold head comprises exactly two cooling stages, $T_{ob}$ is also $T_w$, and the temperature $T_{unt}$ is also $T_k$.

Furthermore, the present invention comprises the use of an apparatus according to the invention, described above, in a method according to the invention, described above. With the apparatus, impurities can be frozen out particularly efficiently thermodynamically as part of the method. Overall, therefore, particularly low operating costs for purification and liquefaction, and in particular for operating the cold head or the associated helium-cooled application device, can be achieved.

Further advantages of the invention will become apparent from the description and the drawings. Likewise, the features according to the invention that are mentioned above and set out in the following can each be used individually per se or together in any desired combination. The embodiments shown and described are not to be understood as an exhaustive list, but instead are of an exemplary nature for describing the invention.

DETAILED DESCRIPTION OF THE INVENTION AND DRAWINGS

The invention is illustrated in the drawings and will be explained in more detail with reference to embodiments.

Figure 4:
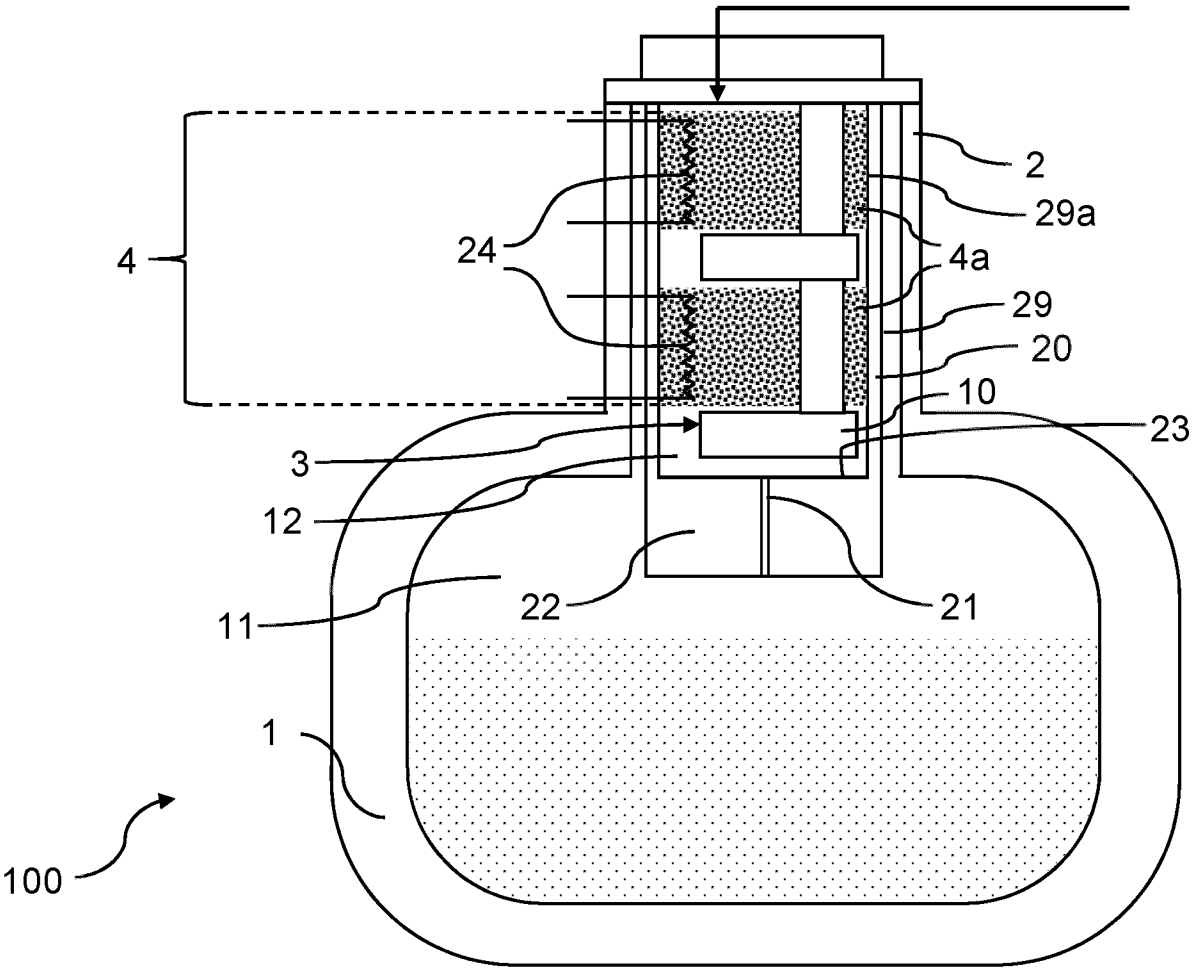
FIG. 4 shows a schematic longitudinal section of an exemplary third embodiment of the apparatus according to the invention with a vacuum-insulated storage vessel with a neck tube into which a cold head container containing a cold head and an adsorber bed protrudes.
Figure 8B:
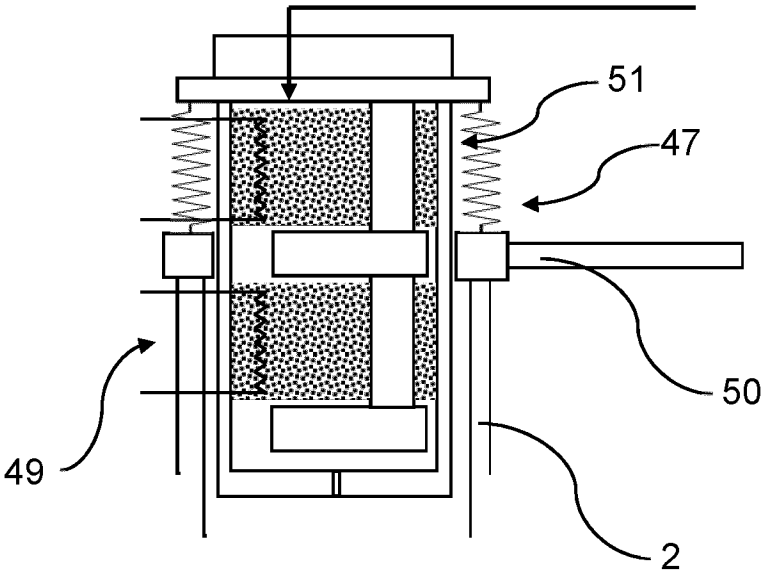
Figure 8A:
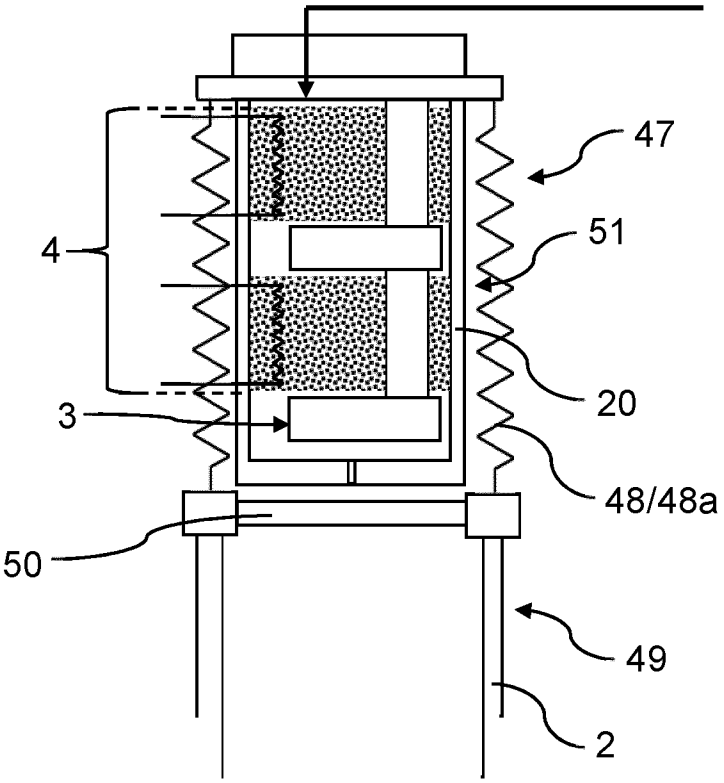
Figure 9:
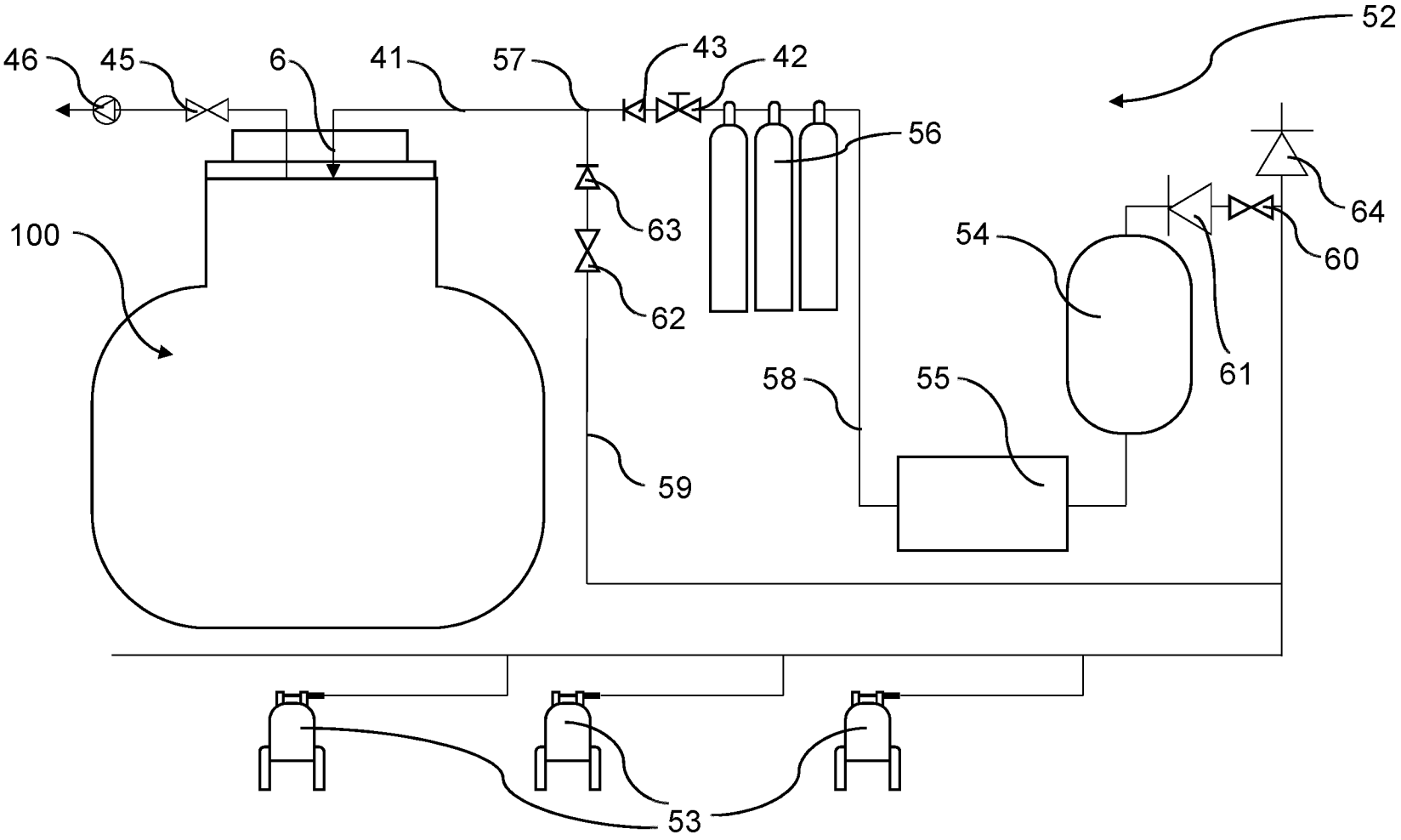

FIG. 8*a* shows a schematic longitudinal section of an exemplary alternative neck tube of the vacuum-insulated storage vessel for the third embodiment of the apparatus according to the invention with a cold head container as shown in FIG. 4, wherein the storage vessel comprises a main part and an extendable attachment part with a flexible wall, which parts are separated from one another by a closed separating slide;

FIG. 8*b* shows a schematic longitudinal section of the neck tube from FIG. 8*a* with the attachment part retracted into the main part and the opened separating slide;

FIG. 9 shows a P&I diagram of an exemplary embodiment of a helium recovery system according to the invention, with an apparatus for purifying and liquefying helium according to the invention, as well as application devices and a balloon accumulator.

Figure 1:
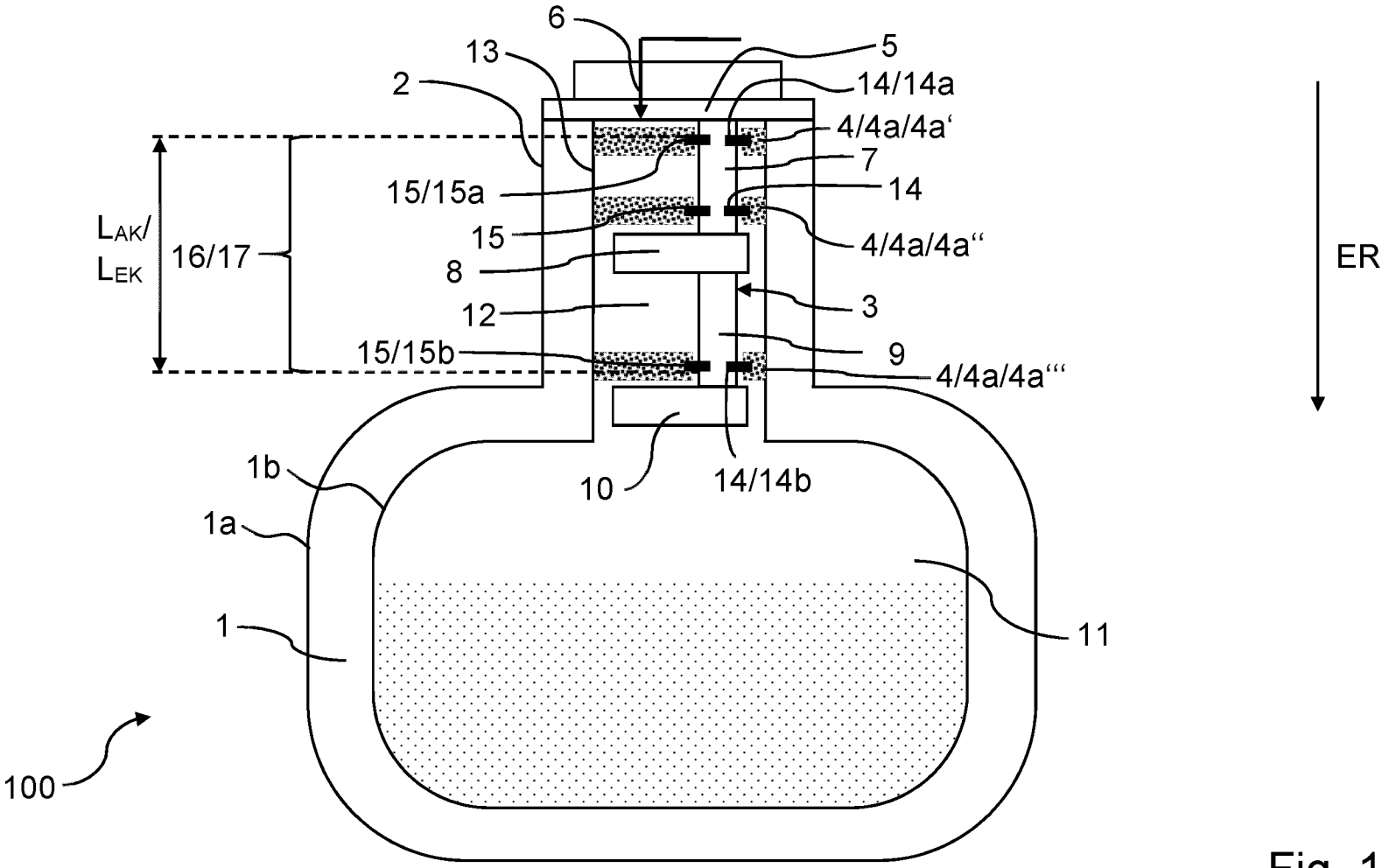
FIG. 1 shows a schematic longitudinal section of an exemplary first embodiment of the apparatus according to the invention with a vacuum-insulated storage vessel with a neck tube in which a cold head and an adsorber bed with three adsorbers are arranged directly.

FIG. 1 shows a schematic longitudinal section of an exemplary first embodiment of an apparatus 100 according to the invention for purifying and liquefying helium. The apparatus 100 comprises a vacuum-insulated storage vessel 1 with a vertically aligned neck tube 2 and a cold head 3 and an adsorber bed 4.

The cold head 3 has a room-temperature, rear end portion 5 which has a feed connection 6 for helium to be purified. The room-temperature end portion 5 is connected via a regenerator 7 to a rearmost, operationally warmest cooling stage 8 (which is operated here at $T_w$ of approx. 70 K), and the warmest cooling stage 8 is connected via a further regenerator 9 to a foremost, operationally coldest cooling stage 10. In the embodiment shown, the cold head 3 therefore has two cooling stages 8, 10. A temperature $T_k$ at which helium can be liquefied can be provided by the coldest cooling stage 10. In the embodiment shown, the coldest cold stage 10 has a temperature $T_k$ of approximately 4.2 K, so that helium gas can be liquefied under normal pressure (approximately 1 bar). The end portion 5, the cooling stage 8, and the cooling stage 10 are arranged in succession along a direction of extension ER of the cold head 3. In the embodiment shown, the two regenerators 7, 9 have the same radial diameter and the two cooling stages 8 and 10 have the same radial diameter (in each case transversely to ER). Alternatively, the regenerator 7 and the warmest cooling stage 8 can be designed such that they each have larger diameters (e.g. twice as large) than the further regenerator 9 and the coldest cooling stage 10 (not shown). The cold head 3 can be part of a pulse tube cryocooler or a Gifford-McMahon cryocooler, for example.

The cold head 3 and the adsorber bed 4 are sunk directly into the neck tube 2 of the vacuum-insulated storage vessel 1. An interior space 11 of the vacuum-insulated storage vessel 1 is closed by the room-temperature, rear end portion 5 of the cold head 3 which rests on the neck tube 2 of the vacuum-insulated storage vessel 1. In the embodiment shown, an inner wall 13 of the neck tube 2 laterally delimits a gas space 12 that runs along the direction of extension ER of the cold head 3, wherein the cold head 3 with the cooling stages 8, 10 and the regenerators 7, 9 protrudes into the gas space 12, and the adsorber bed 4 is also arranged in the gas space 12. The gas space 12 is open at the bottom in the direction of the further interior space 11 of the vacuum-insulated storage vessel 1.

Liquefied helium can be stored in the vacuum-insulated storage vessel 1 (dotted region). The vacuum-insulated storage vessel 1 has an outer wall 1*a* and an inner wall 1*b* between which there is a vacuum for thermal insulation. The vacuum-insulated storage vessel 1 can contain a filling level sensor for liquid helium (not shown), with which for example the point in time can be determined at which the maximum level has been reached in the vacuum-insulated storage vessel 1 and the liquefied helium can be used. Also not shown for reasons of simplification are connections (ports) to remove the liquefied helium from the vacuum-insulated storage vessel 1 or to allow gaseous helium to flow out of the vacuum-insulated storage vessel 1 if a large amount of gaseous helium forms in a short time.

The adsorber bed 4 is thermally coupled to the cold head 3. In the embodiment shown, the adsorber bed 4 comprises three individual adsorbers 4*a*. The thermal coupling takes place here primarily via solid-state contact by means of heat contact elements; the adsorbers 4*a* are connected individually to the cold head 3. It should be noted that thermal coupling can also occur without solid-state contact (i.e. via a gap) via convection and thermal radiation. In the embodiment shown here, there are three coupling-out locations 14 on the cold head 3 (two of them on the regenerator 7, one of them on the regenerator 9) and three coupling-in locations 15 on the adsorber bed 4 (one for each adsorber 4*a*), which are each connected to one another via a heat contact element and thus thermally couple the cold head 3 and the adsorber bed 4.

The coupling-out locations 14 on the cold head 3 are distributed over a coupling-out region 16 which extends over a length $L_{AK}$ in the direction of extension ER of the cold head 3. The two outer coupling-out locations 14*a*, 14*b* with respect to the direction of extension ER form the end points of the coupling-out region 16. Furthermore, the coupling-in locations 15 on the adsorber bed 4 are distributed over a coupling-in region 17 which extends over a length $L_{EK}$ in the direction of extension ER of the cold head 3. The two outer coupling-in locations 15*a*, 15*b* with respect to the direction of extension ER form the end points of the coupling-in region 17. In the embodiment shown, the lengths $L_{AK}$ and $L_{EK}$ are equal.

The temperature in the cold head 3 decreases in the direction of extension ER from the room-temperature end portion 5 to the coldest cooling stage 10. As a result, depending on where the coupling-out locations 14 are located on the cold head 3, different temperatures can be coupled into the adsorber bed 4 via the coupling-in locations 15. In the embodiment shown, the adsorber bed 4 comprises the three individual adsorbers 4*a*. These adsorbers 4*a* are each cooled to different temperatures, as a result of which impurities of various types of a helium gas to be purified that is fed through the gas space 12 can already be frozen out in the different adsorbers 4*a* at or close to their adsorption temperature. As a result, the thermodynamic efficiency of the apparatus can be increased, since the adsorption heat of the impurities can be absorbed by the cold head 3 at or close to their adsorption temperatures. Note that the adsorption temperatures of impurities are usually not too far removed from their respective freezing points. The adsorption temperatures of impurities are usually up to 20K above their corresponding freezing point. In the embodiment shown here, a warmest (uppermost) adsorber 4*a*' has a (approximately uniform) temperature of approx. −20° C. (253K), at which water (freezing point 0° C./273K) can be frozen out quite efficiently. The next colder (intermediate) adsorber 4*a*" here has a (approximately uniform) temperature of approx. −150° C. (123K), at which long-chain hydrocarbons (freezing point e.g. of pentane at −129° C./144K) can be frozen out efficiently. The coldest (lowermost) adsorber 4*a*'" here has a (approximately uniform) temperature of approx. −253° C. (20K), at which oxygen (freezing point −218° C./55K) and nitrogen (−210° C./63K) can be frozen out. The temperatures of the adsorbers 4*a*', 4*a*", 4*a*'" essentially correspond to the temperatures at the associated coupling-out locations on the cold head 3.

The purification and liquefaction of helium can take place with the apparatus 100 shown here as presented below:

A gas stream of helium to be purified is fed into the gas space 12 via the feed connection 6. Guided by the neck tube 2, the gas stream flows along the direction of extension ER of the cooled cold head 3 from the room-temperature end portion 5 along the regenerator 7 to the warmest (upper) adsorber 4*a*'. When flowing through the warmest adsorber 4*a*', which has a temperature of approx. −20° C. (253K), the first impurities which have an adsorption temperature of −20° C. or higher, such as water, are frozen out of the gas stream. The partially purified gas stream continues to flow along the regenerator 7 to the next colder (intermediate) adsorber 4*a*". When flowing through the colder adsorber 4*a*", which has a temperature of approx. −150° C. (123K), the next impurities which have an adsorption temperature between −20° C. and −150° C., such as long-chain hydrocarbons, are frozen out of the gas stream. The gas stream purified of these impurities continues to flow along the regenerator 7 to the warmest cooling stage 8 and from there along the regenerator 9 to the coldest (lower) adsorber 4*a*'". When flowing through the coldest adsorber 4*a*'", which has a temperature of approx. −253° C. (20K), other impurities that have an adsorption temperature between −150° C. and −253° C., e.g. nitrogen or oxygen, are frozen out of the gas stream. The gaseous helium purified in this way then flows further along the regenerator 9 to the coldest cooling stage 10 and is liquefied there at 4.2K. The liquid helium can then drip into the lower part of the vacuum-insulated storage container 1.

Within the scope of the invention, a thermal coupling from the cold head 3 to the adsorber bed 4 is provided on the apparatus 100 via at least two coupling-out locations 14 and two coupling-in locations 15. As a result, at least two different temperatures can be used to cool the adsorber bed 4. In the embodiment shown in FIG. 1, three coupling-out locations 14 and coupling-in locations 15 are provided; however, even more coupling-out locations 14 and coupling-in locations 15 can also be provided. In the embodiment shown, the lengths $L_{AK}$ and $L_{EK}$ are each approximately 25 cm, as a result of which significantly different temperatures can be used thermodynamically efficiently for cooling the adsorber bed 4 or for freezing out impurities in the helium gas to be purified. A coupling-out temperature difference at the cold head 3 which results from the difference in the temperatures of the coupling-out location 14*a* nearest to the room-temperature end portion 5, here at approx. −20° C. (253K), and the coupling-out location 14*b* nearest to the coldest cooling stage 10, here at approx. −253° C. (20K), is approx. 233K. The temperature of the coupling-in location 15*a* essentially corresponds to the temperature of the coupling-out location 14*a*, and the temperature of the coupling-in location 15*b* essentially corresponds to the temperature of the coupling-out location 14*b*. A coupling-in temperature difference at the adsorber bed 4 is then also approximately 233K.

The material for the adsorber bed 4 should have a large inner surface area of at least 300 $m^2/g$, preferably at least 900 $m^2/g$. The large surface allows for greater loading, which means that the adsorber bed 4 has to be regenerated less frequently; in addition, impurities can be frozen out particularly easily. The material used for the adsorber bed 4 can be, for example, an activated carbon bed which is arranged in a net or a cage.

Figure 2:
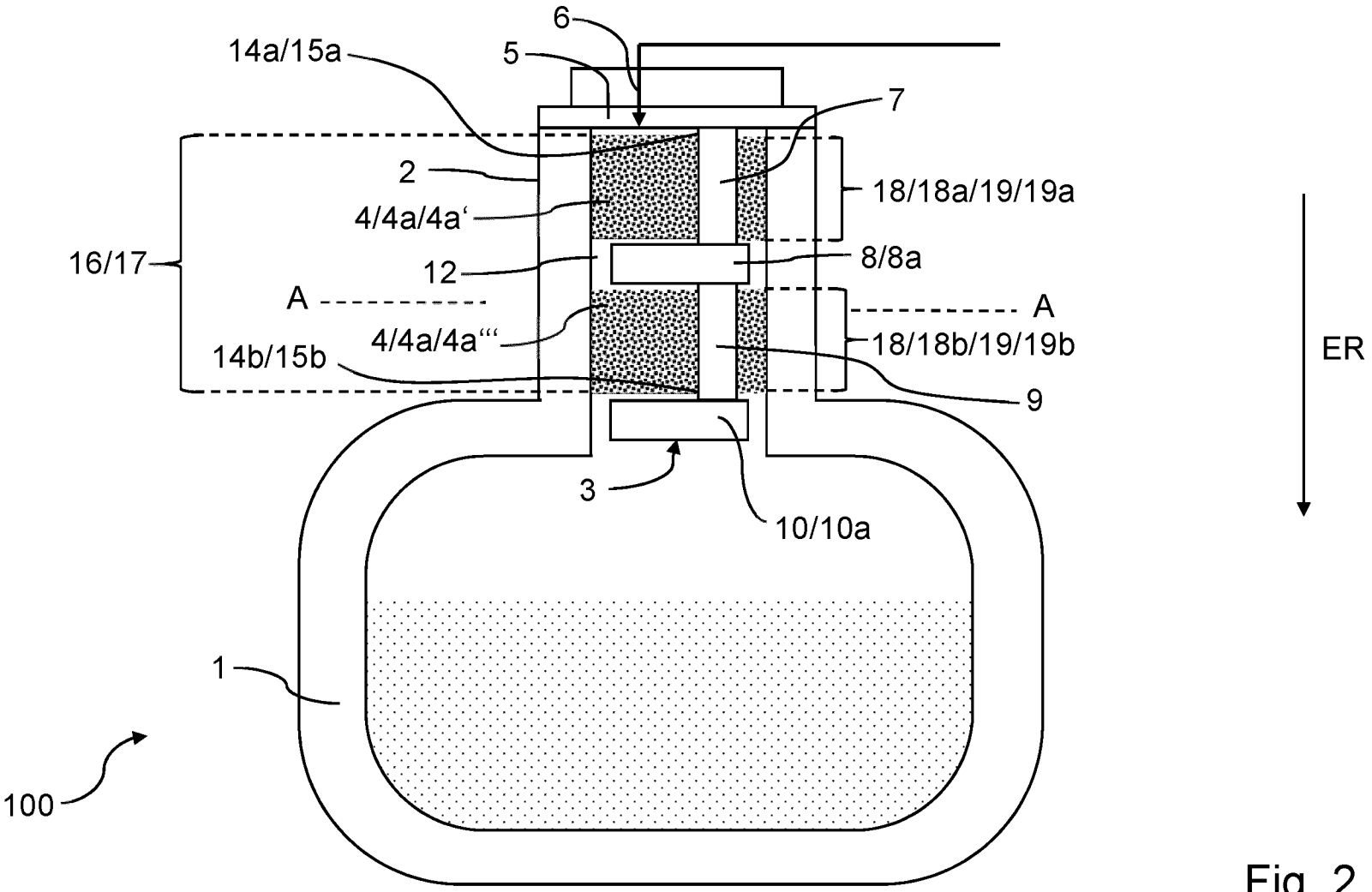
FIG. 2 shows a schematic longitudinal section of an exemplary second embodiment of the apparatus according to the invention similar to that in FIG. 1, wherein the adsorber bed comprises two continuously thermally coupled adsorbers.

FIG. 2 shows a schematic longitudinal section of a second exemplary embodiment of the apparatus 100 according to the invention, similar to that in FIG. 1; only the essential differences are explained (this also applies to the other embodiments below). In this case, the apparatus 100 comprises a vacuum-insulated storage vessel 1 with a neck tube 2 into which the cold head 3 protrudes; the cold head 3 and the adsorber bed 4 are arranged directly in the neck tube 2.

In the embodiment shown, the adsorber bed 4 is made up of two separate adsorbers 4*a*. In the embodiment shown here, the thermal coupling of the adsorber bed 4 to the cold head 3 takes place primarily via direct solid-state contact of the adsorbers 4*a* with the cold head 3. The cold head 3 has two sections 18 and the adsorber bed 4 has two sections 19 via which a continuous thermal coupling between the cold head 3 and the adsorber bed 4 is provided in the direction of extension ER of the cold head 3.

The sections 18, 19 extend over a large part (preferably 80% or more) of the length of the regenerators 7, 9 in the direction of extension ER; in the embodiment shown, the sections 18, 19 each extend over approximately 10 cm. Due to the continuously provided thermal coupling, a temperature gradient in which all temperatures of the spanned temperature range occur can be provided in the corresponding section 19 in the adsorber bed 4. Impurities in a gas stream of helium gas to be purified can thereby freeze out in the adsorber bed 4 at the adsorption temperature, provided the adsorption temperature is in the spanned temperature range. In this way, the cooling power of the cold head 3 is passed on to the adsorber bed 4 in a particularly efficient manner.

In the embodiment shown, the adsorber bed 4 has two separate adsorbers 4*a*', 4*a*'" which are arranged one behind the other along the direction of extension ER and to which the sections 19*a*, 19*b* can be assigned. On the cold head 3, the sections 18*a*, 18*b* are provided one behind the other as the sections 18 in the direction of extension ER.

The rear section 18*a* extends between the room-temperature end portion 5 and the warmest cooling stage 8 and is continuously thermally coupled to the rear section 19*a* of the adsorber bed 4. The warmest cooling stage 8 has a temperature $T_w$ of approx. 70K in this case. The rear section 18*a* of the cold head 3 covers in this case a temperature range from approximately −10° C./263K to approximately-173° C./100K. A temperature difference $TD_{HKK}$ of the rear section 18*a* of the cold head 3 in the direction of extension ER of the cold head 3 is then 163K. A temperature range of the rear section 19*a* of the adsorber bed 4 and a temperature difference $TD_{HAD}$ of the rear section 19*a* of the adsorber bed 4 in the direction of extension ER of the cold head 3 essentially correspond to the temperature range and the temperature difference $TD_{HKK}$ of the rear section 18*a* of the cold head 3.

The further section 18*b* extends between a warmer cooling stage 8*a*, which corresponds to the warmest cooling stage 8 here, and a colder cooling stage 10*a*, which corresponds to the coldest cooling stage 10 here. The further section 18*b* is continuously thermally coupled to the further section 19*b* of the adsorber bed 4. In the case shown here, the further section 19*b* is also the rearmost section.

The warmer cooling stage 8*a* here has a temperature $T_{ob}$ of 70 K (note that $T_{ob}$ is equal to $T_w$ here), and the colder cooling stage 10*a* has a temperature $T_{unt}$ of approx. 4K (note that $T_{unt}$ is equal to $T_k$ here). The further section 18*b* of the cold head 3 here covers a temperature range from approx. −213° C./60K to approx. −263° C./10K. A temperature difference $TD_{WKK}$ of the further section 18*b* of the cold head 3 in the direction of extension ER of the cold head 3 is then 50K. A temperature range of the further section 19*b* of the adsorber bed 4 and a temperature difference $TD_{WAD}$ of the further section 19*b* of the adsorber bed 4 in the direction of extension ER of the cold head 3 essentially correspond to the temperature range and the temperature difference $TD_{WKK}$ of the rear section 18*b* of the cold head 3.

The respective sections 18 of the cold head 3 in the direction of extension ER of the cold head 3 therefore have temperature gradients with temperature differences $TD_{TKK}$ of 163 K and 50 K respectively, and the respective sections 19 of the adsorber bed 4 in the direction of extension ER of the cold head 3 have temperature gradients with temperature differences $TD_{TAD}$ of 163 K and 50 K respectively.

The purification and liquefaction of helium can take place with the apparatus 100 shown here as presented below:

A gas stream of helium to be purified is fed into the gas space 12 via the feed connection 6. Guided by the neck tube 2, the gas stream flows along the direction of extension ER of the cooled cold head 3 from the room-temperature end portion 5 along the regenerator 7 to the warmest (upper) adsorber 4*a*'. The gas stream flows through the warmest adsorber 4*a*' which covers a temperature range from approx. −10° C./263K to approx. −173° C./100K. Impurities having an adsorption temperature greater than or equal to −10° C. are frozen out at an upper part of the adsorber 4*a*', and other impurities having an adsorption temperature between −10° C. and −173° C. are frozen out at a corresponding position in the adsorber 4*a*'. The impurities contained in the gas stream are frozen out to this extent close to their adsorption temperature or at their adsorption temperature. For example, water is frozen out at −10° C./263K, which is only a slightly lower temperature than necessary for water (cf. freezing point of water 0° C./273K). Pentane (as an example of a long-chain hydrocarbon) is frozen out in the adsorber 4*a*' at its adsorption temperature (cf. freezing point of pentane −129° C./144K), since the adsorption temperature is covered in the temperature range of the adsorber 4*a*'. The partially purified gas stream continues to flow along the regenerator 7 to the warmest cooling stage 8 and from there along the regenerator 9 to the coldest adsorber 4*a*''' which has a temperature range of approx. −213° C./60K to approx. −263° C./10K. Impurities having an adsorption temperature between −173° C. and −213° C. are frozen out at an upper part of the adsorber 4*a*''', and other impurities having an adsorption temperature between −213° C. and −263° C. are frozen out at a corresponding position in the adsorber 4*a*'. The remaining impurities contained in the gas stream are thus frozen out again close to their adsorption temperature or at their adsorption temperature. For example, nitrogen is frozen out at −213° C./60K, which is only a slightly lower temperature than necessary for nitrogen (cf. freezing point of nitrogen −210° C./63K). Oxygen is frozen out in the adsorber 4*a*''' at its adsorption temperature (cf. freezing point of oxygen −218° C./55K), since the adsorption temperature is covered in the temperature range of the adsorber 4*a*''. The gaseous helium purified in this way then flows along the regenerator 9 to the coldest cooling stage 10 and is liquefied there at 4.2K. The liquid helium can then drip into the lower part of the vacuum-insulated storage container 1.

A coupling-out temperature difference at the cold head 3 which results, in FIG. 2, from the difference in the temperatures of the coupling-out location 14*a* nearest to the room-temperature end portion 5, here at approx. −10° C. (263K), and the coupling-out location 14*b* nearest to the coldest cooling stage 10, here at approx. −263° C. (10K), is approx. 253K. The temperature of the coupling-in location 15*a* essentially corresponds to the temperature of the coupling-out location 14*a*, and the temperature of the coupling-in location 15*b* essentially corresponds to the temperature of the coupling-out location 14*b*. A coupling-in temperature difference at the adsorber bed 4 is then also approximately 253K.

Figure 3:
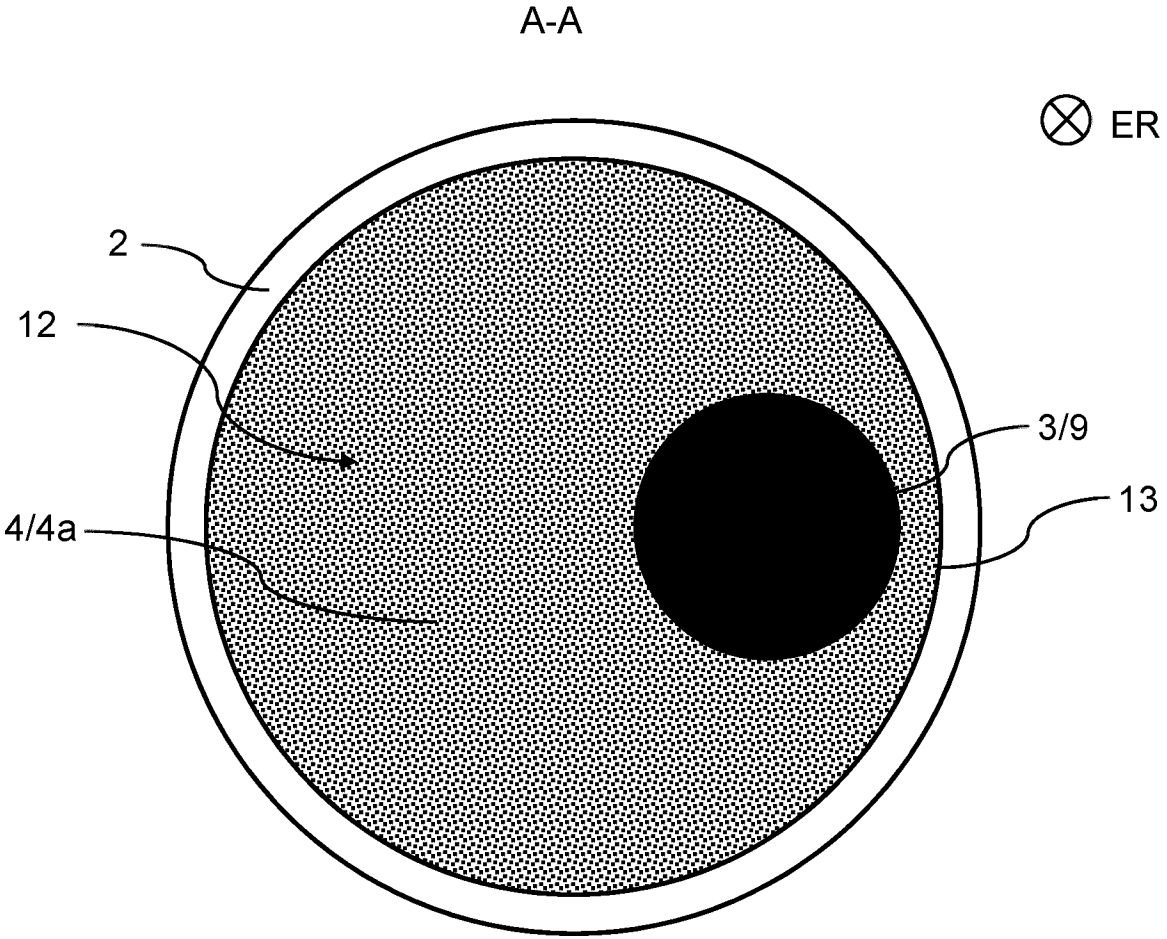
FIG. 3 shows a schematic cross section through the neck tube with cold head and adsorber bed of FIG. 2 in the plane A-A there.

FIG. 3 shows a schematic cross section through the neck tube 2 of FIG. 2 in the plane A-A there. The double-walled, vacuum-insulated neck tube 2 is designed to be circular and encloses the adsorber bed 4 and the cold head 3. The direction of extension ER of the cold head 3 points into the plane of the drawing.

The adsorber 4*a* of the adsorber bed 4 is in direct contact with the inner wall 13 of the neck tube 2 and with the cold head 3, here in the region of the regenerator 9, and occupies a local proportion ANT of the cross section of the gas space 12 available for the helium (perpendicular to the direction of extension ER of the cold head 3) of 100% in this case. The cross section of the gas space 12 delimited by the inner wall 13 of the neck tube 2, insofar as it is not occupied by the cold head 3, is completely filled by the adsorber bed 4; in particular, there is no noticeable gap either on the inner wall 13 or on the (local) outer wall of the cold head 3 through which unpurified helium gas could propagate through the adsorber bed 4 along the direction of extension ER. As a result, the gas stream of helium gas to be purified is completely subjected to the purification by the adsorber bed 4.

FIG. 4 shows a schematic longitudinal section of an exemplary third embodiment of an apparatus 100 according to the invention. The cold head 3 and the adsorber bed 4 have a structure similar to that in FIG. 2 and are arranged in a cold head container 20.

The cold head 3 and the adsorber bed 4 protrude into the cold head container 20. The cold head container 20 in turn protrudes into the neck tube 2 of the vacuum-insulated storage vessel 1. The gas space 12 in which the helium gas to be purified is guided is delimited by the cold head container 20 and the cold head 3. The cold head container 20 delimits the gas space 12 in the embodiment shown here with respect to the interior space 11 of the vacuum-insulated storage vessel 1. The gas space 12 and the interior space 11 are connected here only via an outflow capillary 21, via which helium liquefied at the lowest cooling stage 10 on the cold head 3 flows out into the vacuum-insulated storage vessel 1. The outflow capillary 21 which is designed vertically here is formed in an underside vessel wall 22 of the cold head container 20 and opens into the gas space 12 at an inner base 23 of the cold head container 20, which base is designed horizontally here. If, alternatively, the inner base 23 is not designed horizontally, the outflow capillary 21 preferably opens out at the lowest point of the gas space 12 of the cold head container 20 in order to avoid an accumulation of liquid helium in the cold head container 20 (not shown in detail). In the embodiment shown, the outflow capillary 21 is designed to be straight and is oriented vertically.

If the cold head 3 is heated during a phase of regeneration of the cold head 3 and the adsorber bed 4, the cold head container 20 limits the heat input into the vacuum-insulated storage vessel 1. In the embodiment 100 shown here, the cold head container 20 is designed to be vacuum-insulated, as a result of which particularly good thermal insulation of the gas space 12 of the cold head container 20 from the interior space 11 of the vacuum-insulated storage vessel 1 is achieved. Correspondingly, the cold head container 20 has an outer wall 29 and an inner wall 29*a*, between which a vacuum is provided. Alternatively, it is possible for the cold head container 20 to be designed to be single-walled without vacuum insulation, which means that the space requirement for the cold head container 20 can be reduced (not shown here). Alternatively, the cold head container 20 can be insulated in other ways, such as with foamed materials that limit convection.

The outflow capillary 21 at most results in a small heat input from the cold head container 20 into the vacuum-insulated storage vessel 1 during a regeneration phase.

The adsorber bed 4 has two adsorber heating elements 24 which can be used to heat the adsorber 4*a* during the regeneration of the adsorber bed 4 and thus efficiently desorb the impurities from the adsorber bed 4.

Figure 5:
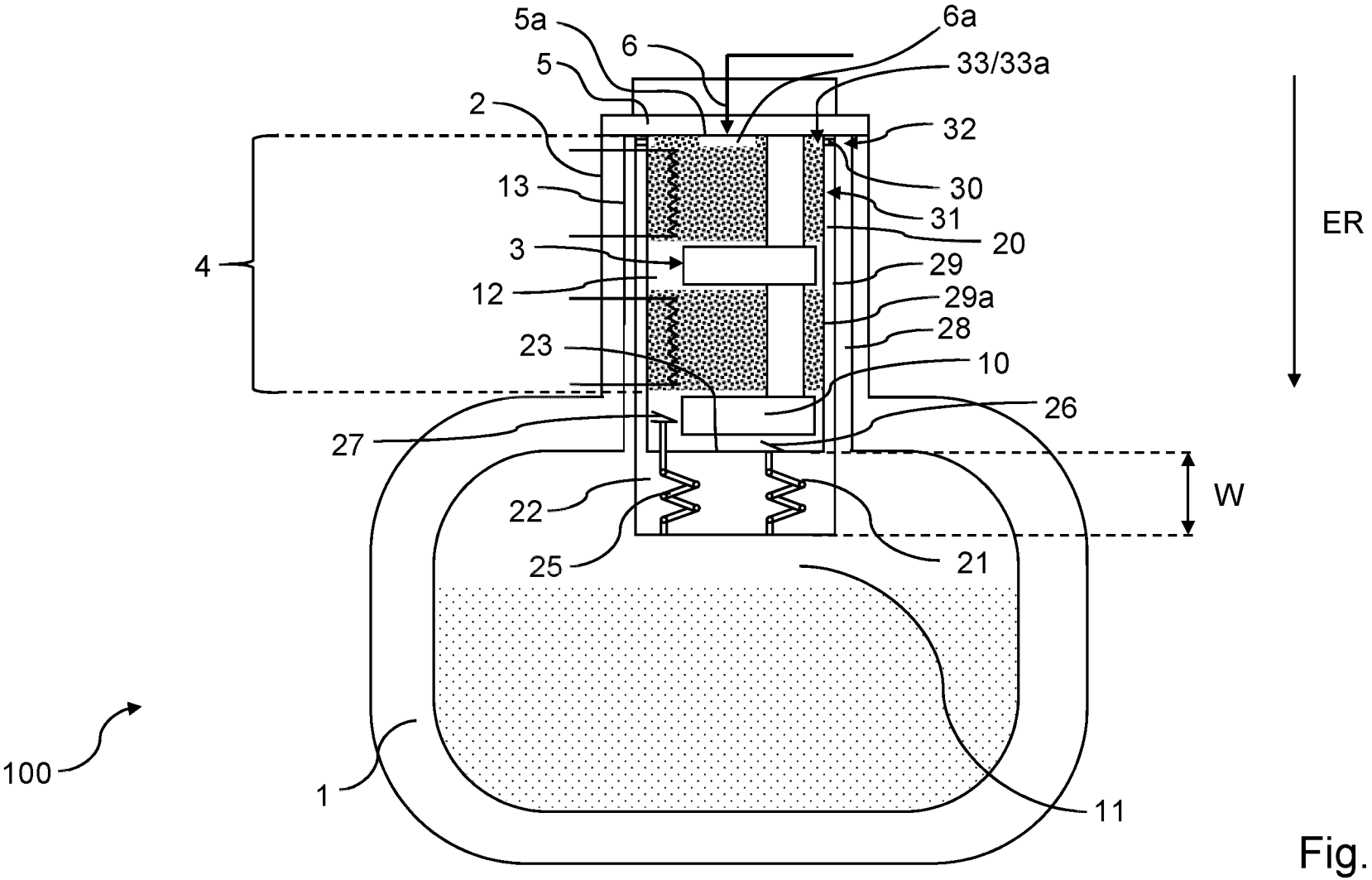
FIG. 5 shows a schematic longitudinal section of an exemplary fourth embodiment of the apparatus according to the invention similar to that in FIG. 4, wherein the cold head container additionally has a recirculation capillary and a passage.

FIG. 5 shows a schematic longitudinal section of an exemplary fourth embodiment of an apparatus 100 according to the invention, similar to that in FIG. 4.

The gas space 12 and the interior space 11 are connected here via the outflow capillary 21 via which helium liquefied on the cold head 3 flows out into the vacuum-insulated storage vessel 1. Furthermore, the gas space 12 and the interior space 11 are connected via a recirculation capillary 25 through which evaporated helium is fed from the vacuum-insulated storage vessel 1 into the cold head container 20 to the cold head 3 close to the coldest cold stage 10, in order to be immediately liquefied again there.

The outflow capillary 21, which is spiral-shaped here, is formed in the underside vessel wall 22 of the cold head container 20 and opens into the gas space 12 at the inner base 23 of the cold head container 20. The likewise spiral-shaped recirculation capillary 25 is formed in the underside vessel wall 22 of the cold head container 20 and opens out above the inner base 23 of the cold head container 20 into the gas space 12 close to the coldest cooling stage 10 of the cold head 3.

Due to the spiral design of the outflow capillary 21 and the recirculation capillary 25, the length of the capillaries 21, 25 (along their winding course) can be increased compared to a wall thickness W of the underside vessel wall 22. In the embodiment shown, a length $L_{AKap}$ of the outflow capillary 21 in the underside vessel wall 22 is approximately 12 cm, and a length $L_{RKap}$ of the recirculation capillary 25 in the underside vessel wall 22 is also approximately 12 cm. The underside vessel wall 22 has a wall thickness W here of approximately 6 cm. Note that $L_{AKap} \geq 2*W$ and $L_{RKap} \geq 2*W$ are preferred. The spiral-shaped outflow capillary 21 and the spiral-shaped recirculation capillary 25 keep the heat input from the cold head container 20 to the vacuum-insulated storage vessel 1 low due to the longer path, in particular in a phase of regeneration of the cold head 3 and the adsorber bed 4, and improve the thermal insulation.

In order to further reduce the heat input due to convective heat transport via the capillaries 21, 25 during a regeneration phase, the outflow capillary 21 can be closed with a closable valve 26. Furthermore, the recirculation capillary 25 can be closed with a closable valve 27.

An annular gap space 28 is provided between the cold head container 20 and the neck tube 2 of the vacuum-insulated storage vessel 1. The annular gap space 28 is delimited by the inner wall 13 of the neck tube 2 of the vacuum-insulated storage vessel 1 and the outer wall 29 of the cold head container 20. Furthermore, the cold head container 20 has a plurality of passages 30; these passages 30 are located close to the room-temperature end portion 5 at an upper end (end region) 31 of the cold head container 20, and lead from an upper region 32 of the annular gap space 28 into an upper region 33 of the cold head container 20. Gaseous helium can thus rise along the annular gap space 28 on the inner wall 13 of the neck tube 2 and thereby cool the neck tube 2, and then be fed into the cold head container 20 for liquefaction, corresponding to an annular convection. The plurality of passages 30 are arranged so as to be distributed in the circumferential direction; in FIG. 5, two of the passages 30 are visible in the sectional view.

The feed connection 6 for newly supplied helium gas to be purified is installed centrally in the room-temperature end portion 5 of the cold head 3. The adsorber bed 4 is designed such that it has direct contact with an inner wall 5*a* of the room-temperature-side end portion 5, with a feed space 6*a* which does not contain an adsorber bed 4 being provided downstream of the feed connection 6 in the cold head 20. In this case, the feed space 6*a* extends approx. 1 cm in the direction of extension ER of the cold head 3 and has a circular surface with a diameter which corresponds to approximately ⅓ of the total diameter of the adsorber bed 4 in the cold head container 20. The unpurified helium gas "flowing past" the adsorber bed 4 (i.e. bypassing the adsorber bed) in the direction of the passage 30 or even a direct inflow of newly inflowing helium gas to be purified into the gap space 28 can be avoided in this way. In addition, this means that the gas stream of helium to be purified can be distributed evenly in the feed space 6*a* and can accordingly be fed evenly through the adsorber bed 4.

In the upper region 33 of the cold head container 20, an annular passage space 33*a* is formed downstream of the passage 30. The passage space 33*a* is delimited by the adsorber bed 4 which is in direct contact with the inner wall 5*a* and an inner wall 29*a* of the cold head container 20. The passage space 33*a* extends here approximately 1 cm in the direction of extension ER of the cold head 3 and approximately 1 cm transversely to the direction of extension into the gas space 12. The pure helium supplied from the annular gap space 28 can be distributed in the passage space 33*a* and can be guided evenly into the adsorber bed 4 over the circumference. The adsorber bed 4 prevents the pure helium gas from being able to flow directly from the gap space 28 into the feed space 6*a*.

Figure 6:
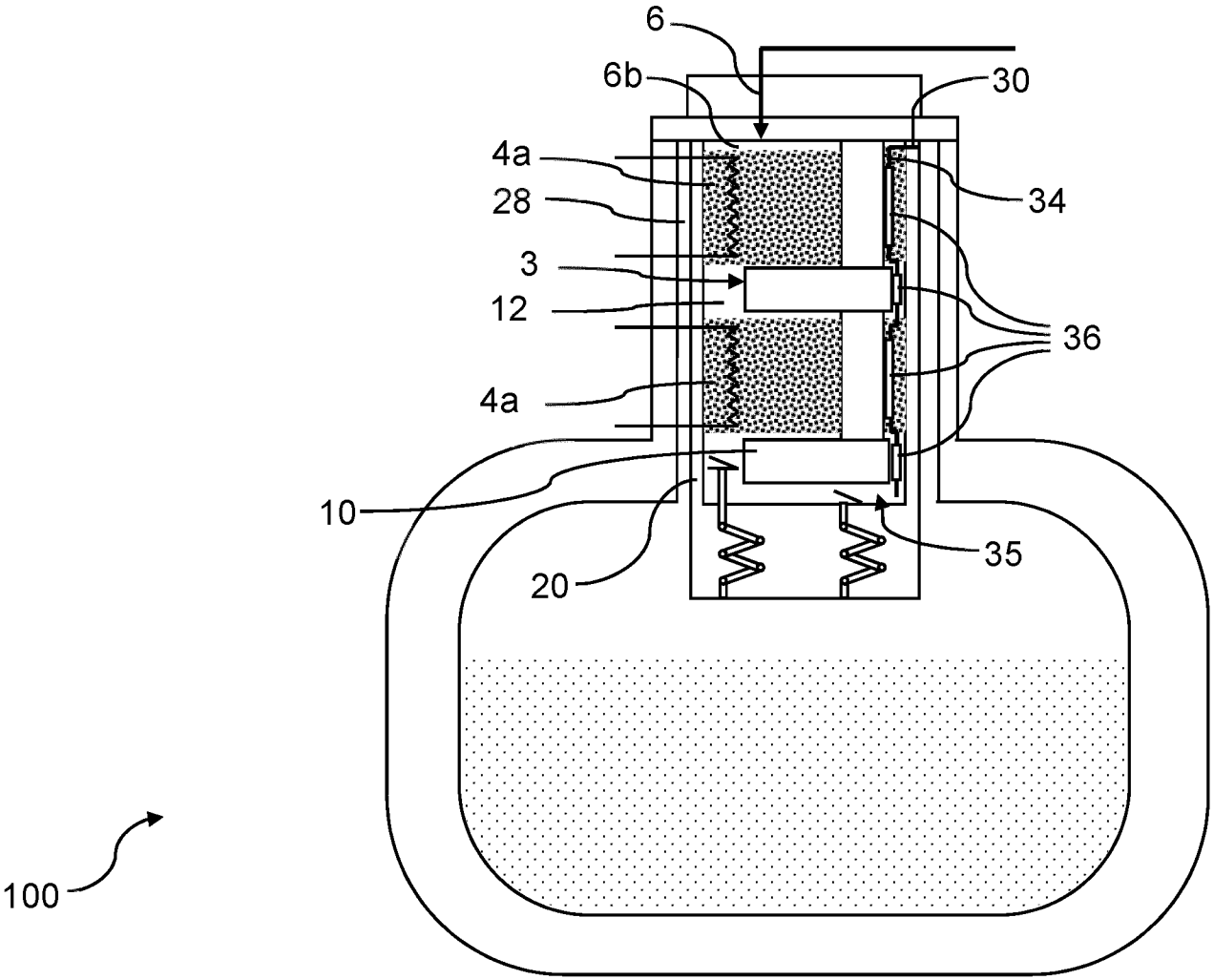
FIG. 6 shows a schematic longitudinal section of an exemplary fifth embodiment of the apparatus according to the invention, similar to that in FIG. 5, wherein a flow line is attached to the passage in the cold head container.

FIG. 6 shows a schematic longitudinal section of an exemplary fifth embodiment of an apparatus 100 according to the invention, similar to that in FIG. 5.

In this case, the cold head container 20 comprises a flow line 34 for evaporated helium from the annular gap space 28. A first (uppermost) part of the flow line 34 forms the passage 30 which leads from the gap space 28 into the cold head container 20. A perforated ring line (not shown in detail here) can be arranged in the gap space 28, in order to take up helium uniformly along the circumference of the gap space 28 and to guide it into the flow line 34. In the cold head container 20, the flow line 34 leads from the passage 30 along the cold head 3 to the coldest cooling stage 10 and opens into a lower region 35 of the gas space 12 of the cold head container 20. The integration of the passage 30 in the flow line 34 separated from the rest of the gas space 12 prevents a new, externally supplied gas stream of helium to be purified from being able to flow through the passage 30 into the annular gap space 28; an uppermost part of the gas space 12 can extend as a free space 6*b* under the feed connection 6 over the full inner cross section of the cold head container 20, as a result of which the introduction of the helium gas to be purified into the adsorber bed can take place evenly. Conversely, the helium from the annular gap space 28 does not have to be fed via the adsorber 4*a*, since this is already highly pure helium which can be liquefied directly at the coldest cooling stage 10 of the cold head 3.

In order to achieve good thermal efficiency when the pure helium is returned from the annular gap space 28, the flow line 34 is equipped with heat exchangers 36 which are thermally coupled to the cold head 3. The pure helium circulates through the annular gap space 28 and the flow line 34 in a manner driven by natural convection. During the regeneration of the adsorbers 4*a* and the cold head 3, the temperature gradient that drives the convection disappears, as a result of which the circulation automatically stops. Alternatively, it is also possible to provide a plurality of flow lines 34 (not shown here).

Figure 7:
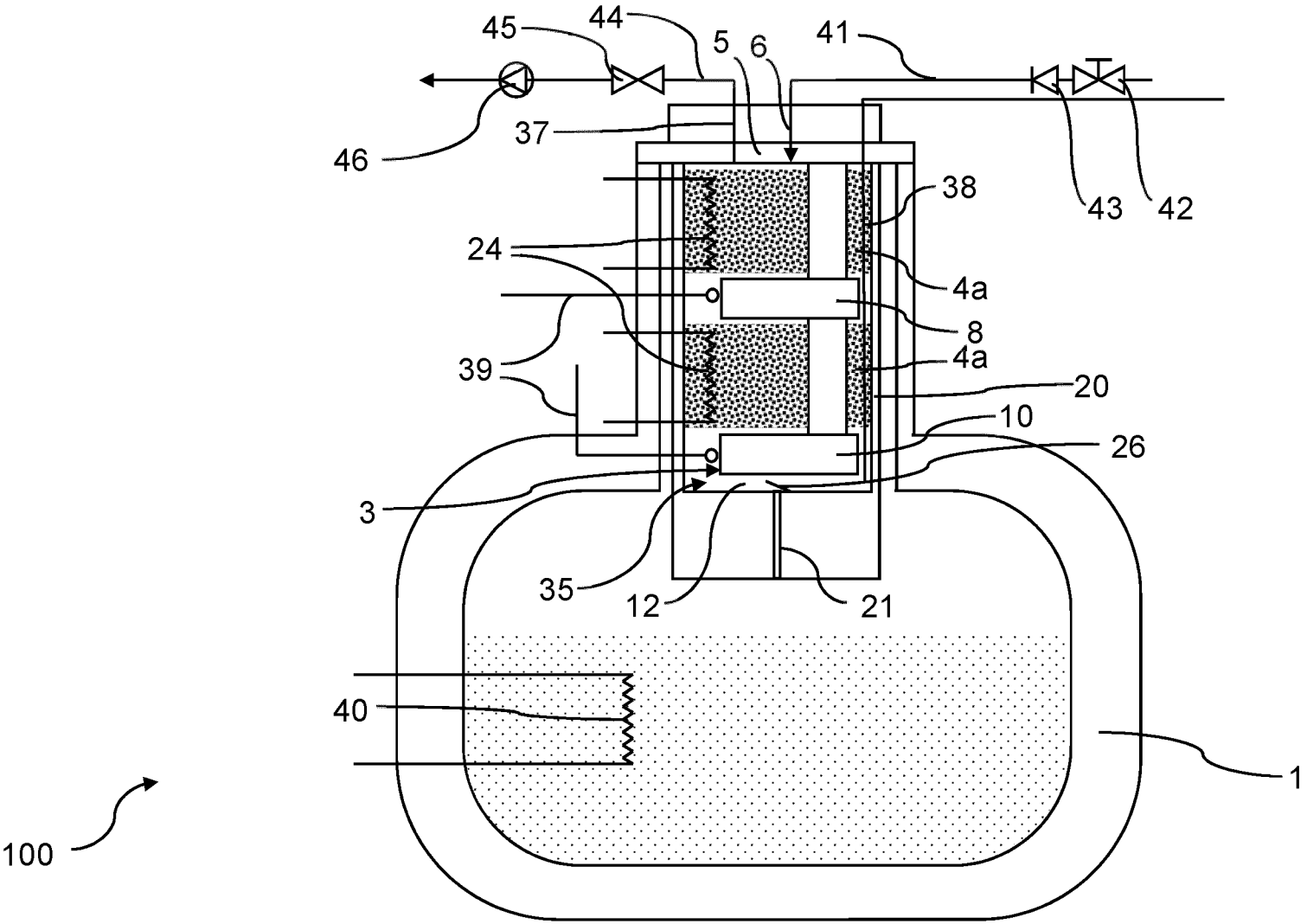
FIG. 7 shows a schematic longitudinal section of an exemplary sixth embodiment of the apparatus according to the invention similar to that in FIG. 4, wherein the apparatus additionally has a discharge connection, the vacuum-insulated storage vessel additionally includes a storage vessel heating element, and the cold head additionally contains a flushing line and an optical monitoring device.

FIG. 7 shows a schematic longitudinal section of an exemplary sixth embodiment of an apparatus 100 according to the invention, similar to that in FIG. 4. In addition to the feed connection 6 for a gas stream of helium to be purified, the apparatus 100 comprises a discharge connection 37 for impurities. A flushing line 38 for a flushing gas and two optical monitoring devices 39 are formed in the cold head container 20. The vacuum-insulated storage vessel 1 also comprises a storage vessel heating element 40.

In a phase of regeneration of the adsorbers 4*a* and the cold head 3, the impurities that were frozen out are discharged via the discharge connection 37 which is formed on the room-temperature end portion 5 of the cold head 3. For this purpose, a pressure control valve 42 is closed on a feed line 41, so that a gas stream of helium to be purified no longer flows through a valve 43 to the feed connection 6 and is no longer fed into the cold head container 20. Additionally, the outflow capillary 21 is closed by the closable valve 26. The cold head 3 is no longer actively cooled so that it can warm up. In this case, the adsorbers 4*a* are heated by adsorber heating elements 24 for faster heating. Typically, the heating of the cold head 3 and the adsorber bed takes place to room temperature. At a discharge line 44 connected to the discharge connection 37, a shut-off valve 45 is opened to remove the impurities via the discharge line 44. The impurities are efficiently sucked out by a suction pump 46 (for example an oil vane or diaphragm pump). By means of the flushing line 38 which, in the cold head container 20, leads from the room-temperature end portion 5 to the coldest cooling stage 10 of the cold head 3 and opens into the lower region 35 of the gas space 12 of the cold head container 20, a flushing gas (e.g. helium, argon, or nitrogen) is fed into the gas space 12 so that the impurities are removed and flushed out even more efficiently.

In this case, two optical monitoring devices 39 (e.g. each comprising a glass fiber line and an optical sensor or a camera, the latter not shown) are used to monitor the cooling stages 8, 10. The optical monitoring devices 39 are aimed directly at the cooling stages 8, 10 of the cold head 3. The loading status of the cooling stages 8, 10 is observed via the optical monitoring devices 39, and the point in time of the regeneration of the cold head 3 is thus determined.

Alternatively or additionally, a monitoring unit (not shown in detail) can be used to determine the point in time of the regeneration of the adsorbers 4*a*. When a specified limit value is exceeded, the monitoring unit can either generate a signal to indicate that regeneration of the adsorbers 4*a* is necessary or be set so that it automatically initiates regeneration when the specified limit value is exceeded. If, for example, a defined helium inflow is provided at the feed connection 6, a pressure difference between the vacuum-insulated storage vessel 1 and the feed connection 6 can be monitored, and the monitoring unit indicates the need for regeneration from a determined pressure difference limit value. In another example, if defined (usually fixed) pressures are provided at the feed connection 6 and in the vacuum-insulated storage vessel 1, a flow rate of helium supplied at the feed connection 6 can be monitored, and the monitoring unit indicates the need for regeneration from a specified flow rate limit value.

Furthermore, it is possible to install a plurality of temperature sensors (not shown in more detail) in the apparatus 100, in order to determine the point in time of the regeneration of the adsorbers 4*a* or to discover a possible malfunction. These temperature sensors can be installed in particular in the vacuum-insulated storage vessel 1, on the cold head 3 (e.g. on the cooling stages 8, 10), and on the adsorbers 4*a*.

For further monitoring of the apparatus 100, the vacuum-insulated storage vessel 1 can be provided with a pressure sensor (not shown in detail) which is connected to a control unit (also not shown). If the control unit determines, for example, that the pressure in the vacuum-insulated storage vessel 1 falls below a lower limit pressure $P_{untgr}$ or exceeds an upper limit pressure $P_{obgr}$, the control unit can then increase the heating power on the storage vessel heating element 40 which, as in the figure shown here, is formed in the vacuum-insulated storage vessel 1, or regulate a cooling power at the cold head 3 and thus change the pressure in the vacuum-insulated storage vessel 1.

FIG. 8*a* shows a schematic longitudinal section of an exemplary neck tube 2 of the vacuum-insulated storage vessel 1 for the third embodiment of the apparatus according to the invention with a cold head container 20 similar to that in FIG. 4, the vacuum-insulated storage vessel comprising an attachment part 47 with a flexible wall 48 and a vacuum-insulated main part 49. FIG. 8*a* shows an extended state.

A separating slide 50 is provided between the main part 49 and the attachment part 47. In the state shown here, the separating slide 50 is closed, as a result of which the main part 49 is separated from the attachment part 47 in a gas-tight manner.

In the state shown, an assembly 51 is arranged in the attachment part 47, comprising the cold head 3 (to the extent that it protrudes into the neck tube 2), the adsorber bed 4, and, in the embodiment shown, also the cold head container 20. The attachment part 47 is designed with the flexible wall 48, here a (for example metal) bellows 48*a*. The assembly 51 can be moved relative to the main part 49 and is in a completely extended state here, as a result of which the assembly 51 is only located in the attachment part 47.

In this completely extended state, the separating slide 50 can be actuated and, with the separating slide 50 closed, the attachment part 47 with the cold head container 20 can be separated from the main part 49. This makes it easily possible, for example, to bring the main part 49 of the vacuum-insulated storage vessel into the vicinity of an NMR magnet and to transfer the liquid helium in the main part 49. The attachment part 47 with the assembly 51 can then be stored separately and, in particular, does not have to be moved. On the one hand, this means that the lines and electrical connections to the assembly 51 do not have to be disconnected; on the other hand, it is not necessary to ensure that the different components in the assembly 51 are compatible with large stray magnetic fields (such as in the vicinity of NMR magnets).

FIG. 8*b* shows a schematic longitudinal section of the exemplary neck tube 2 from FIG. 8*a* with an assembly 51 retracted into the main part 49 and the attachment part 47 folded together when the separating slide 50 is open.

The interior spaces of the main part 49 and the attachment part 47 are open toward one another and the assembly 51 protrudes into the main part 49. A good thermodynamic efficiency of the apparatus is achieved by lowering the assembly 51 into the main part 49, since the distance from the assembly 51 to the vacuum-insulated main part 49 of the storage vessel and the liquid helium stored there is reduced.

FIG. 9 shows a piping and instrumentation diagram (P&ID) of an exemplary embodiment of a helium recovery system 52 in accordance with the present invention.

The helium recovery system 52 comprises the apparatus 100 according to the invention, three helium-cooled application devices 53, a balloon accumulator 54 for gaseous helium, a compressor 55 in which the gaseous helium from the balloon accumulator 54 is compressed, and a pressure accumulator 56 for the compressed gaseous helium from the compressor 55. The feed connection 6 of the apparatus 100 is connected with its feed line 41 via a branch 57 to a first supply line 58 for gaseous helium and a second supply line 59 for gaseous helium.

The first supply line 58 includes a shut-off fitting 60 of the balloon accumulator 54, a valve 61 which opens at a pressure $P_{z1}$, the balloon accumulator 54, the compressor 55, the pressure accumulator 56, the pressure control valve 42, and the valve 43 which is designed here as a check valve. The second supply line 59 includes a shut-off fitting 62 and a check valve 63 which opens at a pressure $P_{z2}$.

Depending on the operating mode of the helium-cooled application devices 53, it is advantageous to guide the evaporated helium to the apparatus 100 either via the first supply line 58 or the second supply line 59. If liquid helium is refilled into the helium-cooled application devices 53, a large amount of gaseous helium can quickly arise. If this large amount of gaseous helium is fed directly into the apparatus 100 according to the invention, this could quickly result in an overload. In order to avoid this, the shut-off fitting 62 is closed and the gaseous helium is guided via the first supply line 58 into the balloon accumulator 54 and collected there. The gaseous helium collected in the balloon accumulator 54 is gradually compressed by the compressor 55 and stored in the pressure accumulator 56. Gaseous helium is then fed into the apparatus 100 according to the invention in a controlled manner via the pressure control valve 42. If high-pressure gaseous helium comes from the helium-cooled application devices 53, which could damage the balloon accumulator 54, a pressure relief valve 64 opens if a specified pressure $P_{über}$ is exceeded. In this case, $P_{über}>P_{z1}$ applies, since otherwise the gaseous helium would only escape via the pressure relief valve 64 and would not flow into the balloon accumulator.

During normal operation of the helium-cooled application devices 53, only small amounts of gaseous helium, which are usually very pure, are generally produced. Instead of guiding these small amounts of gaseous helium through the balloon accumulator 54, in this case the gaseous helium is supplied directly to the apparatus 100 according to the invention via the second supply line 59. For this purpose, the shut-off fitting 62 is opened, as a result of which the gaseous helium flows through the check valve 63. $P_{z1}>P_{z2}$ applies in order for gaseous helium to flow at low pressure (less than $P_{z1}$) through the check valve 63 in the direction of the apparatus 100 and not through the valve 61 and thus first into the balloon accumulator 54. By bypassing the balloon accumulator 54, contamination of the very pure helium coming from the application devices 53 during normal operation in the balloon accumulator 54 can be avoided; ambient air and especially moisture can diffuse into the balloon accumulator 54 to a certain extent.

When the apparatus 100 according to the invention is being regenerated, the pressure control valve 42 and shut-off fitting 62 are closed to stop the flow of helium gas; any new helium gas from the application devices 53 can be temporarily collected in the balloon accumulator 54. The shut-off valve 45 is then opened and the impurities are sucked out of the apparatus 100 according to the invention via the suction pump 46. During general maintenance of the helium recovery system 52, if necessary, the shut-off fitting 62 and the shut-off fitting 60 of the balloon accumulator 54 are closed.

In summary, the invention provides an apparatus in which combined purification and liquefaction can take place with only one cold head. To this end, the cold head and an adsorber bed are arranged in a gas space which is typically delimited by a neck tube of a vacuum-insulated collection vessel or a separate cold head container. By providing different temperatures or preferably a temperature gradient in the adsorber bed through thermal coupling with the cold head via a plurality of coupling-out and coupling-in locations, preferably continuously successive coupling-out and coupling-in locations, impurities can be frozen out at comparatively high temperatures, and often at the highest possible temperature, which is thermodynamically highly efficient.

LIST OF REFERENCE SIGNS

1 Vacuum-insulated storage vessel
1*a* Outer wall (of the vacuum-insulated storage vessel)
1*b* Inner wall (of the vacuum-insulated storage vessel)
2 Neck tube
3 Cold head
4 Adsorber bed
4*a* Adsorber
4*a*' Warmest (uppermost) adsorber
4*a*" Colder (intermediate) adsorber
4*a*'" Coldest (lowermost) adsorber
5 Room-temperature (rear) end portion
5*a* Inner wall
6 Feed connection
6*a* Feed space
6*b* Free space
7 Regenerator
8 Warmest cooling stage
8*a* Warmer cooling stage
9 Regenerator
10 Coldest cooling stage
10*a* Colder cooling stage
11 Interior space
12 Gas space
13 Inner wall (of the vacuum-insulated storage vessel)
14 Coupling-out locations
14*a* Rearmost coupling-out location
14*b* Foremost coupling-out location
15 Coupling-in locations
15*a* Rearmost coupling-in location
15*b* Foremost coupling-in location
16 Coupling-out region
17 Coupling-in region
18 Section (of the cold head)
18*a* Rear section
18*b* Further section
19 Section (of the adsorber bed)
19*a* Rear section
19*b* Further section
20 Cold head container
21 Outflow capillary
22 Underside vessel wall (of the cold head container)
23 Inner base (of the cold head container)
24 Adsorber heating element
25 Recirculation capillary

26 Closable valve (of the outflow capillary)
27 Closable valve (of the recirculation capillary)
28 Annular gap space
29 Outer wall (of the cold head container)
29*a* Inner wall (of the cold head container)
30 Passage
31 Upper end (of the cold head container)
32 Upper region (of the annular gap space)
33 Upper region (of the cold head container)
33*a* Passage space
34 Flow line
35 Lower region (of the cold head container)
36 Heat exchanger
37 Discharge connection
38 Flushing line
39 Optical monitoring device
40 Storage vessel heating element
41 Feed line
42 Pressure control valve
43 Valve (toward the feed connection)
44 Discharge line
45 Shut-off valve
46 Suction pump
47 Attachment part
48 Flexible wall
48*a* Bellows
49 Main part
50 Separating slide
51 Assembly
52 Helium recovery system
53 Helium-cooled application device
54 Balloon accumulator
55 Compressor
56 Pressure accumulator
57 Branch
58 First supply line
59 Second supply line
60 Shut-off fitting (of the balloon accumulator)
61 Valve (with opening pressure $P_{z1}$)
62 Shut-off fitting
63 Check valve (with opening pressure $P_{z2}$)
64 Pressure relief valve (with opening pressure $P_{über}$)
100 Apparatus according to the invention
ER Direction of extension
$L_{AK}$ Length in the direction of extension of the coupling-out region
$L_{EK}$ Length in the direction of extension of the coupling-in region
W Wall thickness (of the underside of the vessel wall)

LIST OF REFERENCES

[D1] JP H11-118349 A
[D2] JP 4 570 546 B2
[D3] WO 2016/005463 A1
[D4] EP 2 567 159 B1
[D5] KR 10 2142312 B1
[D6] CN 107677045A
[D7] C. Wang, "Intermediate cooling from pulse tube and regenerator in a 4K pulse tube cryocooler," Cryogenics 48 (3): 154-159
[D8] https://www.cryomech.com/articles/automatic-helium-purifier/(accessed on 14.04.2021)
[D9] https://qd-europe.com/ch/en/product/helium-gas-purifier/(accessed on 14.04.2021)
[D10] https://quantum-technology.com/purify/cryogenic-purification.html (accessed on 14.04.2021)
[D11] https://www.724pridecryogenics.com/en/prodetail.asp?id=701 (accessed on 15.04.2021)

The invention claimed is:

1. An apparatus for purifying and liquefying helium, comprising:

a cold head having:

a room-temperature, rear end portion (5) on which a feed connection for helium gas to be purified is formed, and a plurality of cooling stages located in a gas space of the apparatus, including a rearmost cooling stage, which is warmest during operation, and a foremost cooling stage, which is coldest during operation, the room-temperature rear end portion and the cooling stages being arranged in succession along a direction of extension (ER) of the cold head, an adsorber bed located in the gas space that is thermally coupled to the cold head, and a vacuum-insulated storage vessel for liquefied helium, wherein the gas space leads from the room-temperature end portion of the cold head, along the cold head- and via the adsorber bed to the foremost cooling stage, and wherein a thermal coupling of the cold head to the adsorber bed is provided by:

at least two coupling-out locations-on the cold head distributed over a coupling-out region with a length of at least 5 cm in the direction of extension, with a coupling-out temperature difference at the cold head between a rearmost coupling-out location nearest to the room-temperature end of the cold head and a foremost coupling-out location nearest to the foremost cooling stage of at least 50 K, and at least two coupling-in locations on the adsorber bed, distributed over a coupling-in region with a length ($L_{EK}$) of at least 5 cm in the direction of extension, with a coupling-in temperature difference at the adsorber bed between a rearmost coupling-in location nearest to the room-temperature end of the cold head and a foremost coupling-in location nearest to the foremost cooling stage of at least 50 K.

2. The apparatus according to claim 1, wherein the coupling-out temperature difference at the cold head is at least 100 K, and the coupling-in temperature difference at the adsorber bed is at least 100 K.

3. The apparatus according to claim 1, wherein a continuous thermal coupling is provided between at least one section of the cold head and at least one section of the adsorber bed for a length of at least 5 cm along the direction of extension (ER).

4. The apparatus according to claim 3, wherein a rear section of the cold head between the room-temperature end portion and the rearmost cooling stage, which has a temperature $T_w$, is continuously thermally coupled to a rear section of the adsorber bed, wherein, along said rear section of the cold head in the direction of extension (ER), the cold head has a continuous temperature gradient which spans a temperature difference $TD_{HKK}$, where $$TD_{HKK} \geq (293\ K - T_w)/2,$$

and wherein, along said rear section of the adsorber bed in the direction of extension (ER) of the cold head, the adsorber bed has a continuous temperature gradient which spans a temperature difference $TD_{HAD}$, where $$TD_{HAD} \geq (293\ \mathrm{K} - T_w)/2.$$

5. The apparatus according to claim 3, wherein the cold head comprises at least one further section between a first cooling stage having an upper temperature $T_{ob}$ and a second cooling stage colder than the first cooling stage having a lower temperature $T_{unt}$, and the adsorber bed comprises at least one further section that is continuously thermally coupled to the further section of the cold head, wherein, along the further section of the cold head in the direction of extension (ER), the cold head has a continuous temperature gradient which spans a temperature difference $TD_{WKK}$ where $$TD_{WKK} \geq (T_{ob} - T_{unt})/2,$$

and wherein, along the further section of the adsorber bed in the direction of extension (ER), the adsorber bed has a continuous temperature gradient which spans a temperature difference $TD_{WAD}$ where $$TD_{WAD} \geq (T_{ob} - T_{unt})/2.$$

6. The apparatus according to claim 1 wherein the vacuum-insulated storage vessel comprises a neck tube, in which the adsorber bed is located and into which the cold head protrudes, an inner wall of the neck tube delimiting the gas space laterally.

7. The apparatus according to claim 1, further comprising a cold head container into which the cold head protrudes and in which the adsorber bed is located, the cold head container delimiting the gas space.

8. The apparatus according to claim 7, wherein the cold head container is vacuum-insulated.

9. The apparatus according to claim 7, wherein the cold head container protrudes into the vacuum-insulated storage vessel.

10. The apparatus according to claim 9, wherein the cold head container comprises an outflow capillary for liquid helium that leads through an underside vessel wall of the cold head container to the vacuum-insulated storage vessel and opens into the gas space at an inner base of the cold head container.

11. The apparatus according to claim 9, wherein the cold head container comprises a recirculation capillary for evaporated helium from the vacuum-insulated storage vessel that leads through an underside vessel wall of the cold head container and opens into the gas space-above an inner base of the cold head container.

12. The apparatus according to claim 9 wherein an upper end of the cold head container comprises at least one passage for evaporated helium from the vacuum-insulated storage vessel adjacent to the room-temperature end portion of the cold head.

13. The apparatus according to claim 12, wherein the cold head container comprises at least one flow line that leads from said at least one passage along the cold head to the foremost cooling stage and opens into a lower region of the gas space.

14. The apparatus according to claim 1, further comprising a discharge connection for impurities on the room-temperature end portion of the cold head.

15. A helium recovery system comprising:

an apparatus for purifying and liquefying helium according to claim 1;

at least one helium-cooled application device;

a balloon accumulator for gaseous helium;

a first supply line for gaseous helium that is connected to the feed connection via a branch, the first supply line leading from the balloon accumulator to the branch; and a second supply line for gaseous helium that is connected to the feed connection via said branch, the second supply line leading from the at least one helium-cooled application device to the branch while bypassing the balloon accumulator.

16. A method for purifying and liquefying helium, the method comprising:

passing a helium gas to be purified through an adsorber bed located in a gas space, the adsorber bed being cooled with a cold head comprising a plurality of cooling stages that protrude into the gas space, including a warmest cooling stage operated at a temperature $T_w$, and a coldest cooling stage operated at a temperature $T_k$, where $T_w > T_k$, the helium gas to be purified being guided through the gas space from a room-temperature end portion of the cold head, on which a feed connection for the helium gas to be purified is formed, along the cold head and via the adsorber bed to the coldest cooling stage of the cold head, the temperature $T_k$ of which is selected such that helium gas purified by the adsorber bed is liquefied at the coldest cooling stage, providing a thermal coupling of the cold head to the adsorber bed from at least two coupling-out locations on the cold head to at least two coupling-in locations on the adsorber bed, such that a coupling-out temperature difference at the cold head between a rearmost coupling-out location nearest to the room-temperature end of the cold head and a foremost coupling-out location nearest to the coldest cooling stage is at least 50 K, and a coupling-in temperature difference at the adsorber bed between a rearmost coupling-in location nearest to the room-temperature end of the cold head and a foremost coupling-in location nearest to the coldest cooling stage is at least 50 K, and collecting the liquefied helium in a vacuum-insulated storage vessel.

17. The method according to claim 16, wherein the room-temperature end portion and the cooling stages are arranged in succession along a direction of extension of the cold head, and a continuous thermal coupling is provided between at least one section of the cold head and at least one section of the adsorber bed along the direction of extension of the cold head, such that along the section of the cold head in the direction of extension of the cold head, the cold head has a continuous temperature gradient which spans a temperature difference $TD_{TKK}$, where $$TD_{TKK} \geq 25\ \mathrm{K},$$

and, along the section of the adsorber bed in the direction of extension (ER) of the cold head, the adsorber bed has a continuous temperature gradient which spans a temperature difference $TD_{TAD}$, where $$TD_{TAD} \geq 25 \text{ K},$$

* * * * *